US009615719B2

(12) United States Patent
Lim et al.

(10) Patent No.: US 9,615,719 B2
(45) Date of Patent: Apr. 11, 2017

(54) DISHWASHER

(71) Applicant: SAMSUNG ELECTRONICS CO., LTD., Suwon-si, Gyeonggi-do (KR)

(72) Inventors: Hyun Hee Lim, Seoul (KR); Su Jin Seong, Suwon-si (KR); Ae Lee Im, Hwaseong-si (KR); Jea Won Lee, Hwaseong-si (KR); Jong Ho Lee, Yongin-si (KR); Jung Min Choi, Hwaseong-si (KR); Hyung Kwen Ham, Jecheon-si (KR); Kyung Ho Hwang, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 416 days.

(21) Appl. No.: 13/909,175

(22) Filed: Jun. 4, 2013

(65) Prior Publication Data

US 2013/0319458 A1 Dec. 5, 2013

(30) Foreign Application Priority Data

Jun. 4, 2012 (KR) ..... 10-2012-0060044
Oct. 9, 2012 (KR) ..... 10-2012-0111722

(51) Int. Cl.
*A47L 15/00* (2006.01)
*A47L 15/02* (2006.01)
(Continued)

(52) U.S. Cl.
CPC ..... *A47L 15/0039* (2013.01); *A47L 15/13* (2013.01); *A47L 15/4208* (2013.01); *A47L 15/0057* (2013.01); *A47L 15/4206* (2013.01); *A47L 15/4236* (2013.01); *A47L 2301/04* (2013.01); *A47L 2401/09* (2013.01); *A47L 2401/10* (2013.01); *A47L 2401/12* (2013.01); *A47L 2401/20* (2013.01); *A47L 2501/01* (2013.01);
(Continued)

(58) Field of Classification Search
CPC ..... A47L 15/0039; A47L 15/4202; A47L 15/4208; A47L 15/13; B08B 7/0071; B08B 7/026; B08B 7/028
See application file for complete search history.

(56) References Cited

U.S. PATENT DOCUMENTS

2009/0211600 A1* 8/2009 Steiner et al. ..... 134/10

FOREIGN PATENT DOCUMENTS

CN 101043837 9/2007
CN 101528103 9/2009
(Continued)

OTHER PUBLICATIONS

Machine translation: DE10249130; Steiner et al.; 2004.*
Chinese Office Action dated Nov. 2, 2016 from Chinese Patent Application No. 201310219299.5, 19 pages.

*Primary Examiner* — Michael Kornakov
*Assistant Examiner* — Natasha Campbell
(74) *Attorney, Agent, or Firm* — Staas & Halsey LLP

(57) ABSTRACT

A dishwasher including a washing chamber to wash dishes, a sump concavely formed at a lower portion of the washing chamber to collect water used in washing, a microfilter disposed at the sump to filter out dirt produced when the dishes are washed, and an ultrasonic generator to radiate ultrasonic waves toward the microfilter. Since the microfilter is automatically cleaned by the ultrasonic generator, a user may not need to manually clean the microfilter.

9 Claims, 21 Drawing Sheets

(51) Int. Cl.
*A47L 15/13* (2006.01)
*A47L 15/42* (2006.01)

(52) U.S. Cl.
CPC ..... *A47L 2501/02* (2013.01); *A47L 2501/03* (2013.01); *A47L 2501/06* (2013.01); *A47L 2501/16* (2013.01); *A47L 2501/28* (2013.01); *A47L 2501/34* (2013.01); *A47L 2501/36* (2013.01)

(56) References Cited

FOREIGN PATENT DOCUMENTS

| | | | |
|---|---|---|---|
| CN | 201564450 | | 9/2010 |
| CN | 201641934 | | 11/2010 |
| DE | 10249130 | A1 * | 5/2004 |
| EP | 1980193 | A1 * | 10/2008 |

* cited by examiner

DISHWASHER

CROSS-REFERENCE TO RELATED APPLICATIONS

This application claims the benefit of Korean Patent Application Nos. 10-2012-0060044, filed on Jun. 4, 2012, and 10-2012-0111722, filed on Oct. 9, 2012, in the Korean Intellectual Property Office, the disclosures of which are incorporated herein by reference.

BACKGROUND

1. Field

Embodiments of the present disclosure relate to a dishwasher having a microfilter disposed at a sump which collects water to filter out dirt while dishes are washed.

2. Description of the Related Art

A dishwasher generally includes a body provided with an inlet at the front thereof to allow dishes to be introduced, a washing chamber disposed at the inside of the inlet, and a door to open and close the inlet. The washing chamber includes a rack to retain dishes placed thereon, and a nozzle to spray water onto the dishes retained in the rack to wash off the dishes.

A sump is arranged at the lower portion of the washing chamber to collect water used for washing the dishes and then circulate or discharge the collected water. The wash water and the debris separated from the dishes are collected in the sump.

If the debris collected in the sump is introduced into the circulation pump used for circulation of water, it may disturb operation of the circulation pump. Therefore, a filter is disposed at the sump to prevent the debris from being introduced into the circulation pump by filtering off the debris.

The filter includes a microfilter to filter out small debris, a coarse filter to filter out debris larger than a predetermined size, and a fine filter having holes whose size is larger than that of the holes of the microfilter and smaller than that of the holes of the coarse filter. When the microfilter is used, fine debris may inevitably be stuck. Accordingly, a user may need to regularly remove the filter from the sump and clean the same.

The dishwasher carries out main operations of washing, rinsing and drying. Once the main operations are completed and the user removes the dishes from the dishwasher, the dishwasher is left with a certain amount of moisture and residual contaminants contained in the closed environment of the dishwasher until it is used again.

A water collecting basin positioned at the lower portion of the inside of the dishwasher is a space functioning as a starting point at which the wash water and contaminants are collected and recirculated. When all the main operations are completed, part of the debris removed by washing the dishes remains in the water collecting basin.

Particularly, a large amount of debris tends to reside in the filter in the water collecting basin. In addition, due to the closed structure of the dishwasher, the inside of the dishwasher remains highly humid after washing is carried out. Even when the door is left open, a certain amount of water remains in the water collecting basin, which may cause high humidity in the water collecting basin. In this case, the contaminants remaining in the filter may facilitate proliferation of microorganisms.

SUMMARY

Therefore, it is an aspect of the present disclosure to provide a dishwasher which does not require a microfilter to be separated for cleaning.

It is another aspect of the present disclosure to provide a dishwasher which may keep the inside thereof clean by performing sterilization even when the dishwasher is left unused.

Additional aspects of the disclosure will be set forth in part in the description which follows and, in part, will be apparent from the description, or may be learned by practice of the disclosure.

In accordance with one aspect of the present disclosure, a dishwasher includes a washing chamber to wash dishes, a sump concavely formed at a lower portion of the washing chamber to collect water used in washing, a microfilter disposed at the sump to filter out debris produced when the dishes are washed, and an ultrasonic generator to radiate ultrasonic waves toward the microfilter.

The microfilter may include a filter membrane to filter out micro-contaminants, and a frame formed in a lattice shape to allow the filter membrane to maintain a constant shape.

The microfilter may be formed in a shape of a cylinder having an open top and an open bottom, and the ultrasonic generator may be formed in a shape of a cylinder having a smaller diameter than the microfilter and disposed in the microfilter.

The ultrasonic generator may include a vibration plate formed of a metallic material, and an ultrasonic vibrator disposed at one surface of the vibration plate to vibrate the vibration plate.

The vibration plate may be formed to have an arc-shaped cross section and disposed at an inner circumferential surface of the sump, and the ultrasonic vibrator may adjoin an outer circumferential surface of the vibration plate through the sump.

The vibration plate may be formed in a shape of a flat plate and disposed at an inner lower surface of the sump, and the ultrasonic vibrator may adjoin a lower surface of the vibration plate through the sump.

The microfilter may be adapted to have a diameter gradually increasing from one of upper and lower ends thereof to the other one of the upper and lower ends.

The dishwasher may further include a turbidity sensor installed at the sump to measure a turbidity of water contained in the sump.

In accordance with another aspect of the present disclosure, a dishwasher includes a body provided therein with a washing chamber to wash dishes and a sump concavely formed at a lower portion of the washing chamber, at least one nozzle disposed in the washing chamber to spray water toward the dishes disposed in the washing chamber, at least one filter disposed at the sump to filter out debris, and an ultrasonic generator disposed at the sump to radiate ultrasonic waves toward the filter.

In accordance with another aspect of the present disclosure, a method of controlling a dishwasher includes supplying water to a washing chamber, spraying water in a sump arranged at a lower portion of the washing chamber onto dishes through a nozzle to wash the dishes, discharging water used in washing the dishes from the sump to outside, and radiating ultrasonic waves toward a microfilter with the sump filled with water and cleaning the microfilter.

The radiating and cleaning may be performed before the discharging begins.

The radiating and cleaning may be performed while the discharging is performed.

Performing the cleaning may take a shorter time than performing the discharging.

The discharging may include a first discharging to discharge a portion of the water used in washing the dishes to outside through a drain pump, and a second discharging to discharge the remaining portion of the water used in washing the dishes to the outside through the drain pump, wherein, after the first discharging, the drain pump may temporarily stop, the microfilter may be cleaned, and then the second discharging may be performed.

The cleaning may be selectively performed according to a turbidity of the water in the sump sensed through a turbidity sensor.

In accordance with another aspect of the present disclosure, a method of controlling a dishwasher includes supplying water to submerge a microfilter installed at a sump of a washing tub in the water, radiating ultrasonic waves toward the microfilter and cleaning the microfilter, and discharging the water from the sump to outside.

The supplying, the cleaning and the discharging may be selectively performed according to manipulation by a user.

The supplying, the cleaning and the discharging may be selectively performed according to a turbidity of the water sensed by a turbidity sensor disposed at the sump.

The supplying, the cleaning and the discharging may be repeated until the turbidity of the water sensed by the turbidity sensor decreases below a specific level.

In accordance with another aspect of the present disclosure, a dishwasher includes a washing chamber to wash dishes, a sump to collect water supplied to the washing chamber, a microfilter disposed in the sump to filter out debris contained in the water, an ultrasonic generator to radiate ultrasonic waves toward the microfilter, a heater to heat water to be supplied to the sump, and a controller to operate at least one of the ultrasonic generator and the heater to perform sterilization of the microfilter.

The microfilter may be formed in a shape of a cylinder having an open top and an open bottom, and a lateral surface thereof may be provided with a filter membrane to filter out micro-contaminants and a frame allowing the filter membrane to maintain a constant shape.

The ultrasonic generator may include an ultrasonic vibrator formed in a shape of a cylinder having a smaller diameter than the microfilter and disposed in the microfilter.

The ultrasonic generator may include a vibration plate formed of a metallic material, and an ultrasonic vibrator disposed at one surface of the vibration plate to vibrate the vibration plate.

The vibration plate may be formed to have an arc-shaped cross section and disposed at an inner circumferential surface of the sump, and the ultrasonic vibrator may adjoin an outer circumferential surface of the vibration plate through the sump.

The vibration plate may be formed in a shape of a flat plate and disposed at an inner lower surface of the sump, and the ultrasonic vibrator may adjoin a lower surface of the vibration plate through the sump.

The microfilter may be adapted to have a diameter gradually increasing from one of upper and lower ends thereof to the other of the upper and lower ends.

The dishwasher may further include a water level sensor to detect the amount of water collected in the sump, wherein the water level sensor may be installed at a first water supply pipe to receive water supplied from an external water supply source, and may include a flowmeter to generate a pulse signal with rotation of a turbine produced when the water flows therethrough.

The heater may be installed at a second water supply pipe supplying water to the sump and may be adapted to heat water flowing through the second water supply pipe.

The dishwasher may further include a water temperature sensor to detect a temperature of water in the sump, wherein the water temperature sensor may be installed between the heater and the sump to sense a temperature of water heated by the heater and introduced into the sump.

The dishwasher may further include a sump circulation module to guide water pumped out of the sump back to the sump to circulate the water.

The sump circulation module may include a circulation pump connected to the sump to pump out water in the sump, and a sump circulation pipe to guide the water pumped out by the circulation pump outside of the sump to circulate the water.

The sump circulation module may further include a circulation control valve provided with a first side connected to an outlet of the circulation pump, a second side connected to an inlet of a circulation pipe guiding the water in the sump to a nozzle, and a third side connected to an inlet of the sump circulation pipe, to guide the water pumped out by the circulation pump to one of the circulation pipe and the sump circulation pipe.

The sump circulation module may further include a channel diversion valve provided with a first side connected to an outlet of a first water supply pipe receiving water supplied from an external water supply source, a second side connected to an inlet of a second water supply pipe supplying water to the sump, and a third side connected to an outlet of the sump circulation pipe receiving circulating water from the sump, to guide water supplied from one of the first water supply pipe and the sump circulation pipe to the second water supply pipe.

The controller may supply water introduced from an external water supply source to the sump up to a predetermined reference water level, and heat water to be supplied to the sump to a predetermined reference water temperature.

The predetermined reference water level may include a water level allowing the microfilter disposed in the sump to be submerged.

The predetermined reference water temperature may include a temperature higher than a temperature of the water supplied from the external water supply source or than a highest temperature allowing reproduction of microorganisms.

The controller may perform supply of water to the sump while heating the water to a predetermined reference water temperature at the same time.

The controller may perform supply of water to the sump up to a reference water level and then heat the water to a reference water temperature while circulating the water in the sump through the sump circulation module.

When the water in the sump satisfies a reference water level and a reference water temperature, the controller may radiate ultrasonic waves toward the microfilter for a first predetermined reference time.

The first predetermined reference time may include a time until a concentration of microorganisms in the sump becomes less than or equal to 1 log(CFU/mL).

After radiating ultrasonic waves toward the microfilter for the first predetermined reference time, the controller may discharge the water from the sump to outside.

After discharging the water from the sump to the outside, the controller may re-supply water introduced from the external water supply source to the sump up to the predetermined reference water level, and circulate water in the sump through the sump circulation module a plurality of times.

After circulating the water in the sump through the sump circulation module the plurality of times, the controller may discharge the water re-supplied to the sump to outside and terminate the sterilization.

When the controller receives, from a user, a signal to operate a main function including washing, rinsing and drying in a standby mode after terminating the sterilization, the controller may start to perform the main function.

In case that the controller does not receive, from a user, any signal in a standby mode after terminating the sterilization for a predetermined second reference time since termination of the sterilization, the controller may resume the sterilization.

The predetermined second reference time may represent a time from termination of the sterilization until the sterilization is resumed.

In accordance with another aspect of the present disclosure, a method of controlling a dishwasher including a sump, a microfilter disposed in the sump, and a sump circulation module to circulate water pumped out of the sump back to the sump and performing a sterilization operation for the microfilter, includes supplying water introduced from an external water supply source to the sump up to a predetermined reference water level, heating water to be supplied to the sump to a predetermined reference water temperature, when water in the sump satisfies the reference water level and the reference water temperature, radiating ultrasonic waves toward the microfilter for a first predetermined reference time, and discharging the water in the sump outside of the sump.

The predetermined reference water level may include a water level allowing the microfilter disposed in the sump to be submerged.

The predetermined reference water temperature may include a temperature higher than a temperature of the water supplied from the external water supply source or a highest temperature allowing reproduction of microorganisms.

The heating may include heating the water while supplying the water to the sump.

The heating may include supplying the water to the sump up to a reference water level and then heating the water to a reference water temperature while circulating the water in the sump through the sump circulation module.

The first predetermined reference time may include a time until a concentration of microorganisms in the sump becomes less than or equal to 1 log(CFU/mL).

The method may further include re-supplying water introduced from the external water supply source to the sump up to the predetermined reference water level after discharging the water in the sump outside of the sump, circulating water in the sump through the sump circulation module a plurality of times, and discharging the water re-supplied to the sump outside and terminating the sterilization operation.

The method may further include, when a signal to operate a main function including washing, rinsing and drying is received from a user in a standby mode after the termination of the sterilization operation, starting to perform the main function.

The method may further include, in case that any signal is not received from a user in a standby mode after the termination of the sterilization operation for a predetermined second reference time since the termination of the sterilization operation, resuming the sterilization operation.

The predetermined second reference time may represent a time from the termination of the sterilization operation until the sterilization operation is resumed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
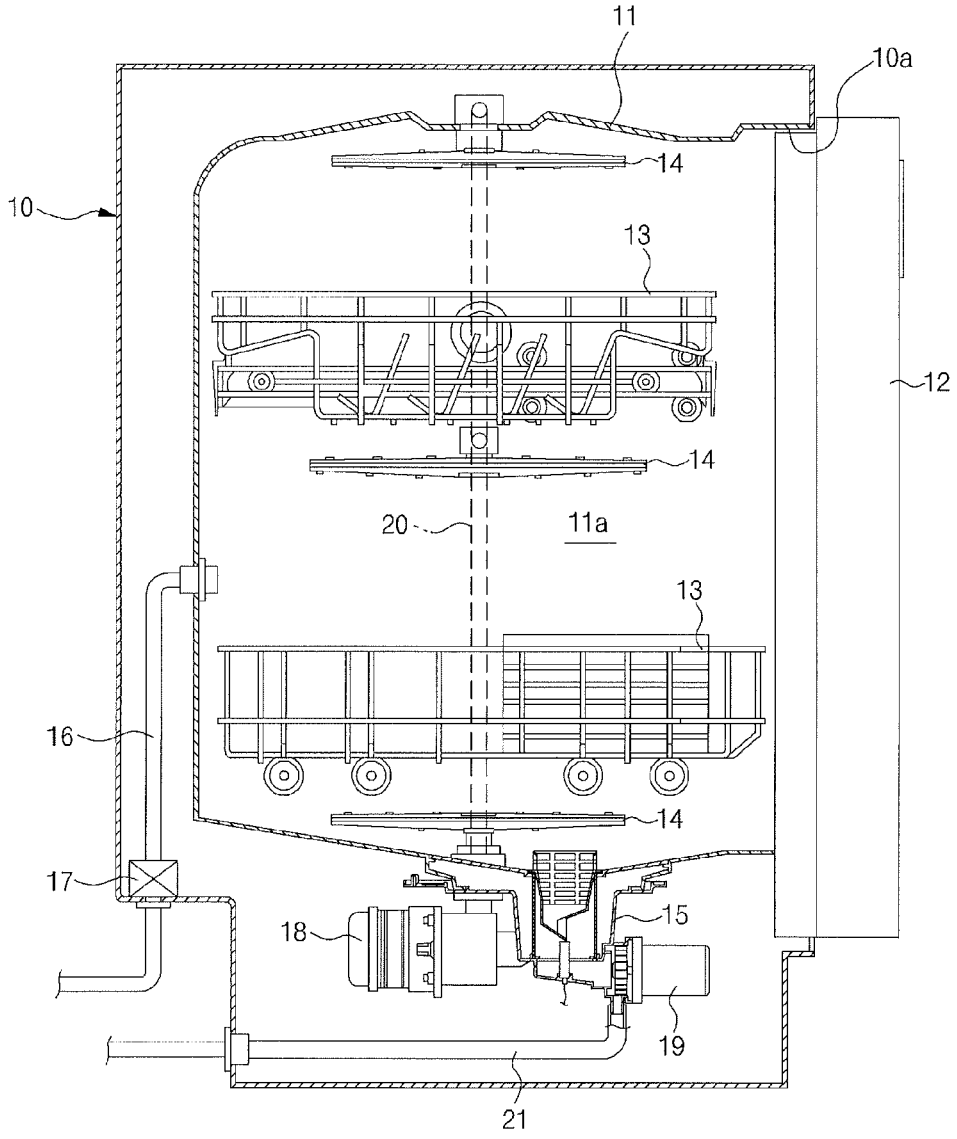
FIG. 1 is a cross-sectional view illustrating a dishwasher according to an exemplary embodiment of the present disclosure.

Reference will now be made in detail to the embodiments of the present disclosure, examples of which are illustrated in the accompanying drawings, wherein like reference numerals refer to like elements throughout.

As shown in FIG. 1, a dishwasher according to the illustrated embodiment includes a body 10 forming an external appearance thereof and provided with an inlet 10*a* at the front of the body to allow dishes to be placed in and withdrawn from the body, a washing tub 11 disposed at the inside of the inlet 10*a* to form a washing chamber 11*a* to wash the dishes, and a door 12 having a lower end rotatably installed at the lower portion of the body 10 to open and close the inlet 10*a*.

Disposed in the washing chamber 11*a* are a rack 13 to retain dishes, and a nozzle 14 to spray water onto the dishes retained in the rack 13 disposed in the washing chamber 11*a*. Two racks 13 are provided and vertically arranged. The racks 13 are installed in the washing chamber 11*a* to be movable forward and backward such that they are introduced into the washing chamber 11*a* by moving backward and withdrawn from the washing chamber 11*a* by moving forward. In addition, three nozzles 14 are provided and rotatably installed respectively at the lower sides of the two racks 13 and the upper side of one of the racks 13 disposed at the upper side, to spray water onto the dishes retained in the racks 13.

A water supply pipe 16 to guide water from an external water supply source (not shown) to the washing chamber 11*a* is connected to the rear side of the washing tub 11, and a water supply valve 17 to selectively open and close the water supply pipe 16 is disposed in the water supply pipe 16.

A sump 15 is concavely formed at the lower portion of the washing tub 11 to collect water supplied into the washing chamber 11*a* through the water supply pipe 16 or water ejected from the nozzles 14. Installed at the sump 15 are a drain pump 19 to discharge collected water from the sump 15 to the outside, and a circulation pump 18 to transfer the collected water from the sump 15 to the nozzle 14 to circulate the water. A drain pipe 21 to guide water from the drain pump 19 to the outside is connected to the drain pump 19, and a circulation pipe 20 to guide water to the nozzles 14 is connected to the circulation pump 18.

Figure 2:
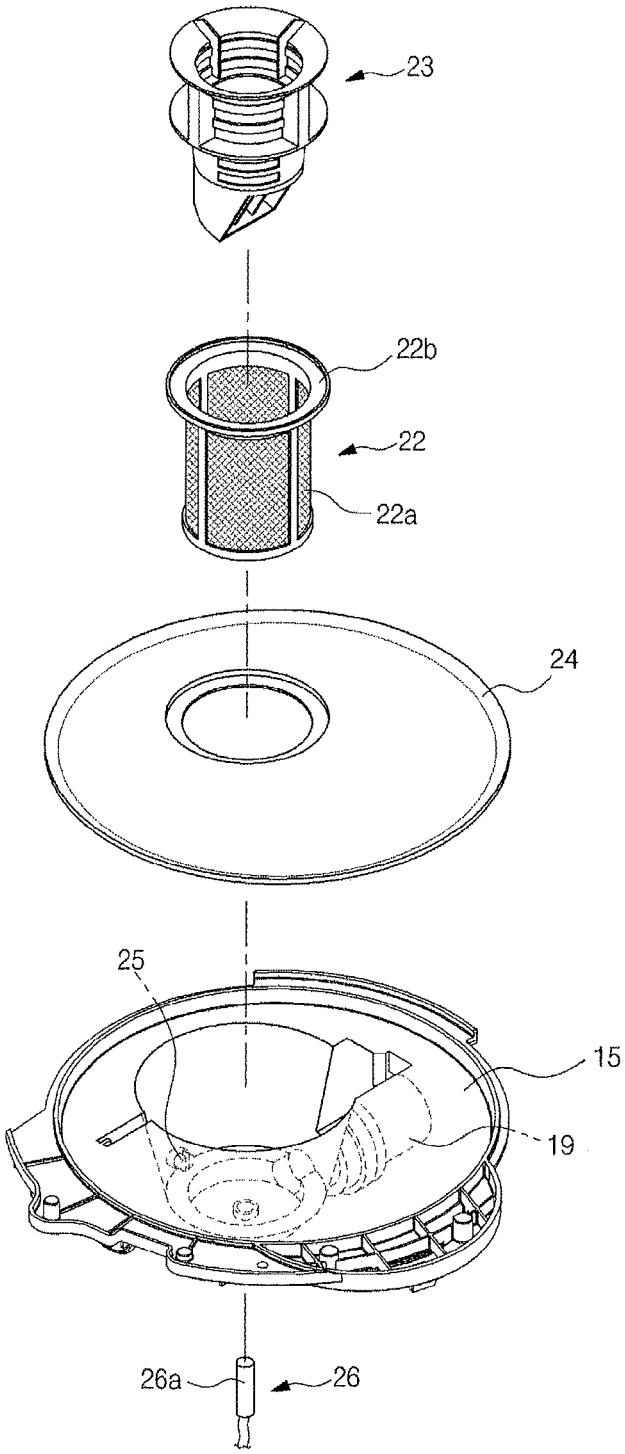
FIG. 2 is a perspective view illustrating a sump of the dishwasher according to the illustrated embodiment and an ultrasonic generator installed at the sump.
Figure 3:
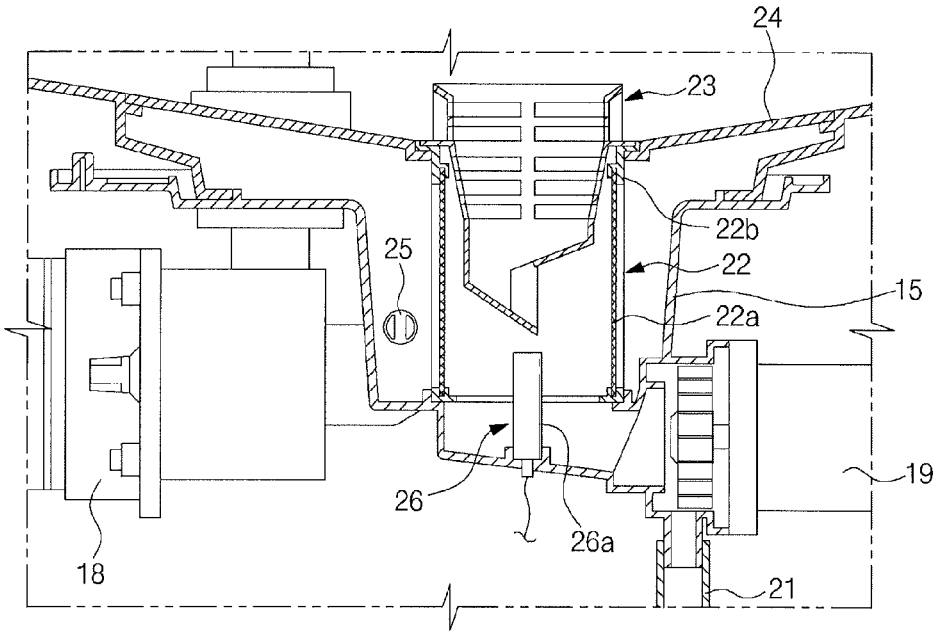
FIG. 3 is a cross-sectional view illustrating the sump of the dishwasher according to the illustrated embodiment and the ultrasonic generator installed at the sump.

In addition, as shown in FIGS. 2 and 3, installed at the sump 15 are filters 22, 23 and 24 to filter out debris contained in the water collected in the sump 15 to prevent debris larger than a specific size from being transferred to the circulation pump 18, and a turbidity sensor 25 to measure the turbidity T of water retained in the sump 15.

In the illustrated embodiment, the filters 22, 23 and 24 include a microfilter 22 formed in the shape of a cylinder which is open at the top and bottom thereof to filter out debris of a small size, a coarse filter 23 installed through the open top of the microfilter 22 to filter out debris containing particles larger than a specific size before the debris reaches the microfilter 22, and a fine filter 24 formed to have filter holes larger than those of the microfilter 22 and smaller than those of the coarse filter 23 and installed to cover the sump 15.

The coarse filter 23 is formed in a lattice pattern to filter out the debris of particles larger than a specific size and is detachably installed at the open top of the microfilter 22. The microfilter 22 includes a filter membrane 22*a* to allow water to pass therethrough and filter out fine debris contained in the water, and a frame 22*b* formed in the lattice pattern to maintain the cylindrical arrangement of the filter membrane 22*a*.

The filter membrane 22*a* of the microfilter 22 has fine tissues, for example, a fibrous material, to filter out fine debris. If the fine debris is caught in the tissues of the filter membrane 22*a*, it may not be easy to remove.

Accordingly, in the illustrated embodiment, the dishwasher includes an ultrasonic generator 26 to automatically wash the filter membrane 22*a* of the microfilter 22. The ultrasonic generator 26 radiates ultrasonic waves toward the microfilter 22 installed at the sump 15 which is filled with water such that cavitation is produced in the water in the sump 15 by the ultrasonic waves and thereby the debris caught in the tissues of the filter membrane 22*a* of the microfilter 22 is separated from the filter membrane 22*a*.

In the illustrated embodiment, the ultrasonic generator 26 is provided with an ultrasonic vibrator 26*a* formed in the shape of a cylinder having a smaller diameter than the microfilter 22 and disposed in the microfilter 22 through the open bottom of the microfilter 22. If the ultrasonic vibrator 26*a* of the ultrasonic generator is formed in a cylindrical shape and disposed in the microfilter 22 as described above, the ultrasonic waves generated by the ultrasonic vibrator 26*a* may be radiated outward in a radial direction thereof and uniformly transferred to the entire filter membrane 22*a* of the microfilter 22 such that the entire filter membrane 22*a* may be uniformly cleaned.

Figure 4:
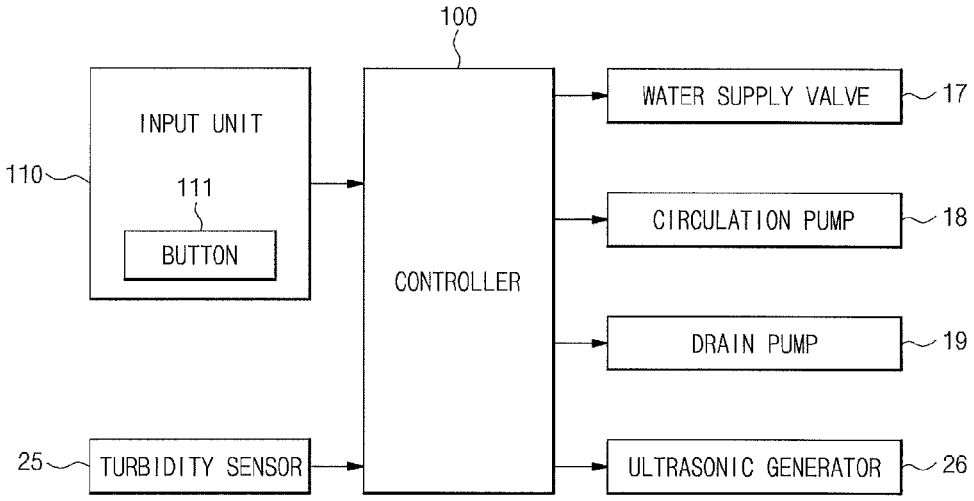
FIG. 4 is a control block diagram applied to the dishwasher of the illustrated embodiment.

As shown in FIG. 4, the dishwasher further includes an input unit 110 provided with a button 111 to allow a user to select an operation of the dishwasher to be carried out, and a controller 100 to receive signals from the input unit 110 and the turbidity sensor 25 to control the water supply valve 17, the circulation pump 18, the drain pump 19 and the ultrasonic generator 26.

Hereinafter, a method of controlling the dishwasher configured as above will be described in detail with reference to the drawings.

When the dishwasher is operated after the rack 13 retaining dishes to be washed is disposed in the washing chamber 11*a*, water is supplied into the washing chamber 11*a* through the water supply pipe 16.

The water supplied into the washing chamber 11*a* collects in the sump 15, and the water collected in the sump 15 is transferred to the nozzles 14 via the circulation pump 18 and the circulation pipe 20. Then, the water is sprayed from the nozzles 14 onto the dishes to wash the dishes. Thereby, debris on the dishes is separated from the dishes and collects in the sump 15 together with the water. The debris in the water collected in the sump 15 is filtered out by the coarse filter 23 and the microfilter 22, and the water is transferred to the nozzles 14 again by the circulation pump 18 and used to wash the dishes.

After washing is completed, the debris is filtered out by the filters 22, 23 and 24 disposed in the sump 15 and the water collects in the sump 15 to be discharged to the outside through the drain pipe 21 according to the operation of the drain pump 19.

Figure 5:
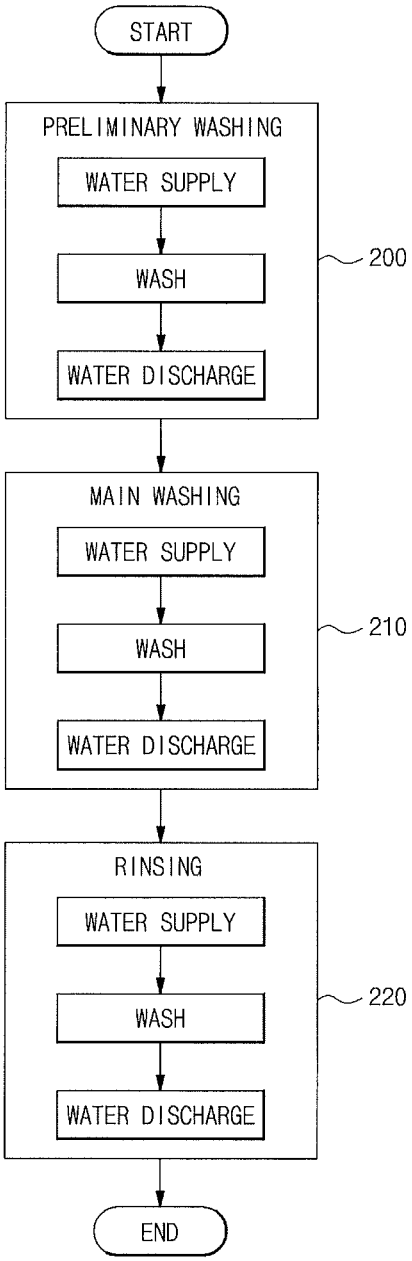
FIG. 5 is a flowchart illustrating washing operations carried out by the dishwasher of the illustrated embodiment.

Washing of the dishes by the dishwasher is carried out by repeating the operations of water supply, washing and discharge several times. That is, as shown in FIG. 5, preliminary washing (operation 200) is first performed by carrying out the three operations once with some of the detergent supplied to wash the dishes. After the preliminary washing is completed, main washing (operation 210) is performed by supplying the remaining detergent not used for the preliminary washing and repeating the operations of water supply, wash and discharge at least once. Subsequently, rinsing (operation 220) is performed by repeating the operations of water supply, wash and discharge at least once to remove detergent from the dishes.

In the illustrated embodiment, cleaning of the microfilter 22 by ultrasonic waves generated by the ultrasonic generator 26 is carried out as the water in the sump 15 is discharged to the outside by the drain pump 19. This operation is performed to discharge the debris separated from the microfilter 22 to the outside along with the water. Here, the ultrasonic waves generated by the ultrasonic generator 26 are transferred to the microfilter 22 only when water is present in the sump 15. Accordingly, the microfilter 22 may be cleaned by the ultrasonic generator 26 with the discharge of water by the drain pump 19 temporarily stopped, to more efficiently clean the microfilter 22. Alternatively, the time during which the ultrasonic generator 26 operates may be set to be shorter than the time of discharge such that the ultrasonic generator 26 cleans the microfilter 22 when water is contained in the sump.

While the ultrasonic generator 26 is illustrated as operating during discharge of the water from the sump 15 to the outside, embodiments of the present disclosure are not limited thereto. Cleaning of the microfilter 22 by the ultrasonic generator 26 may be carried out at any time as long as the sump 15 is filled with water as a transmission medium.

Accordingly, cleaning of the microfilter 22 by the ultrasonic generator 26 may be carried out during discharge of water or before the discharge begins after completion of washing.

In addition, the cleaning of the microfilter 22 may be directly selected by the user through operation of the button 111 provided to the dishwasher.

Figure 6:
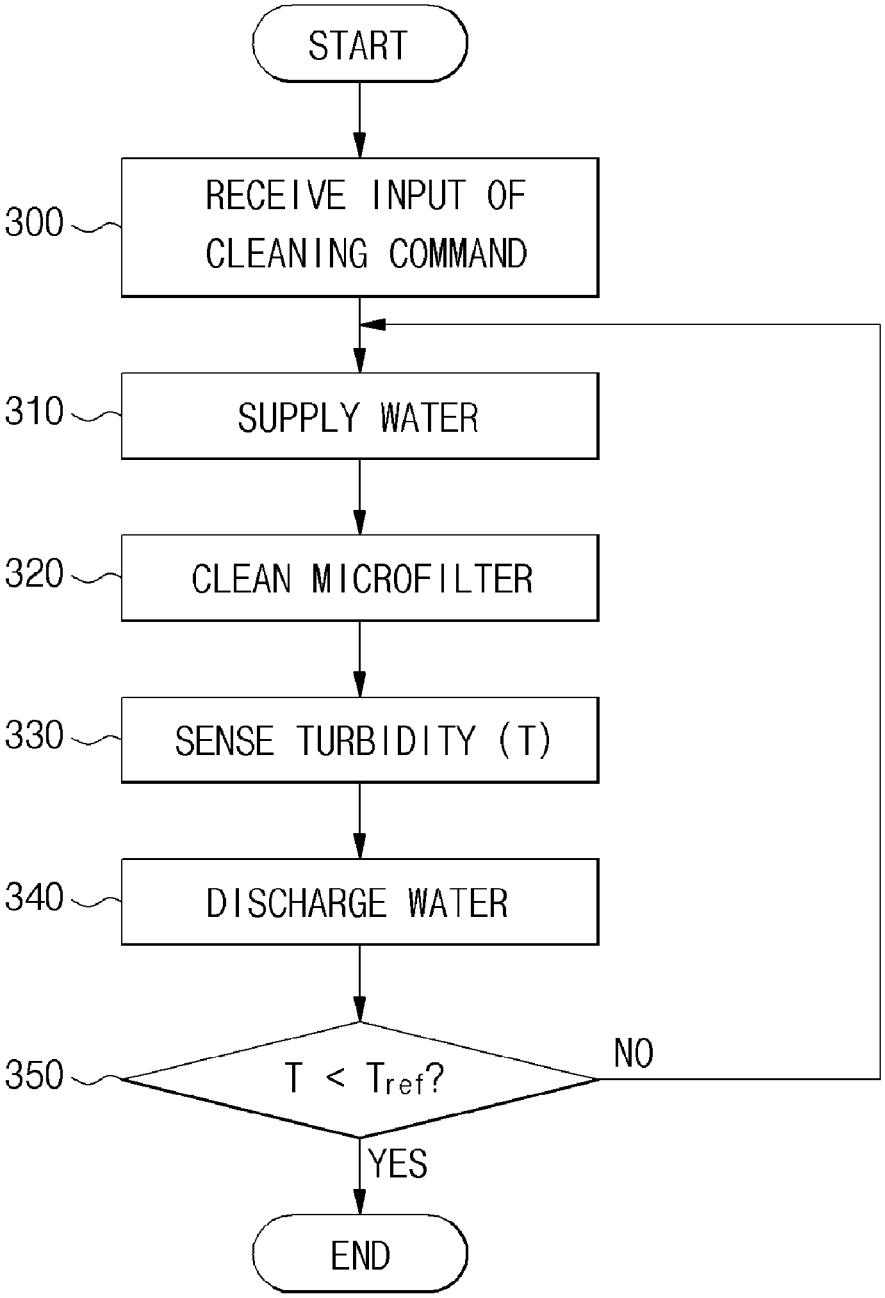
FIG. 6 is a flowchart illustrating cleaning of the microfilter independently carried out by the dishwasher of the illustrated embodiment.

As shown in FIG. 6, once the user selects the function of cleaning of the microfilter 22 through manipulation of the button 111 and the command of cleaning is input (operation 300) to the controller 100, the controller 100 controls the water supply valve 17 to allow water supply (operation 310) to be carried out until the microfilter 22 installed at the sump 15 is submerged. After the water supply (operation 310) is completed, the controller 100 drives the ultrasonic generator 26 to allow cleaning of the microfilter 22 (operation 320). After cleaning of the microfilter 22 (operation 320) is performed for a certain time, the turbidity T of the water in the sump 15 is sensed by the turbidity sensor 25 (operation 330). After the turbidity T is sensed (operation 330), the controller 100 drives the drain pump 19 to discharge the water from the sump 15 to the outside (operation 340). After discharge of water (operation 340) is completed, the turbidity T sensed by the turbidity sensor 25 is compared with a predetermined reference turbidity Tref (operation 350). If it is determined that the turbidity T is lower than the reference turbidity Tref, the operation of cleaning the microfilter 22 is terminated. On the other hand, if it is determined that the turbidity T sensed by the turbidity sensor 25 is equal to or higher than the reference turbidity Tref, the operations of supplying water (operation 310), cleaning the microfilter (operation 320), sensing the turbidity T (operation 330) and discharging the water (operation 340) are repeated until the sensed turbidity T is lower than the reference turbidity Tref.

FIGS. 7 to 10 illustrate a dishwasher having an ultrasonic generator 26 according to other embodiments of the present disclosure applied thereto. The ultrasonic generator 26 shown in FIGS. 7 to 10 includes a vibration plate 26*b*, 26*b*' formed of a metallic material, and an ultrasonic vibrator 26*c*, 26*e* disposed to adjoin the vibration plate 26*b*, 26*b*' at one surface thereof. The ultrasonic generator 26 configured as above allows ultrasonic waves generated by the ultrasonic vibrator 26*c* to be transferred to the vibration plate 26*b*, 26*b*' such that the ultrasonic waves are radiated toward the microfilter 22 through the vibration plate 26*b*, 26*b*'.

Figure 7:
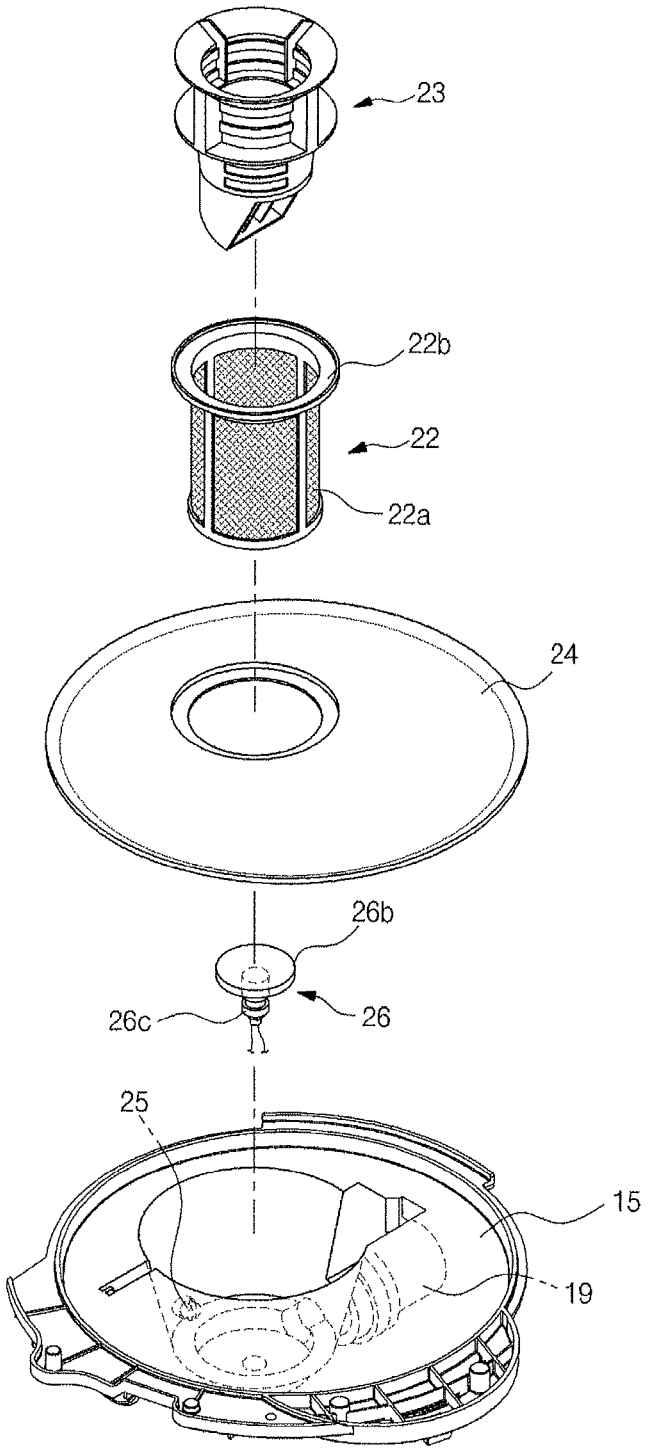
FIG. 7 is a perspective view illustrating a sump of a dishwasher according to another embodiment of the present disclosure and an ultrasonic generator installed at the sump.
Figure 8:
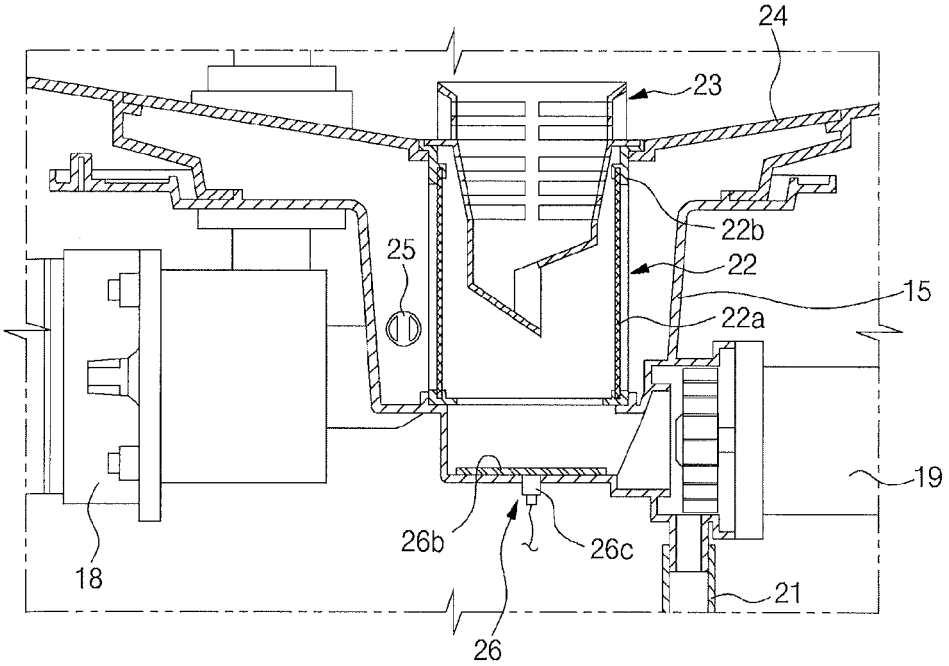
FIG. 8 is a cross-sectional view illustrating the sump of the dishwasher according to the illustrated embodiment and the ultrasonic generator installed at the sump.

In the embodiment shown in FIGS. 7 and 8, the vibration plate 26*b* is formed in the shape of a circular disc and disposed at the inner lower surface of the sump 15. The ultrasonic vibrator 26*c* is arranged through the lower surface of the sump 15 and the upper surface thereof is adapted to contact the lower surface of the vibration plate 26*b*. Accordingly, the ultrasonic waves generated by the ultrasonic vibrator 26*c* is radiated toward the microfilter 22 disposed at the upper side of the ultrasonic vibrator 26*c* through the vibration plate 26*b* to clean the microfilter 22.

Figure 9:
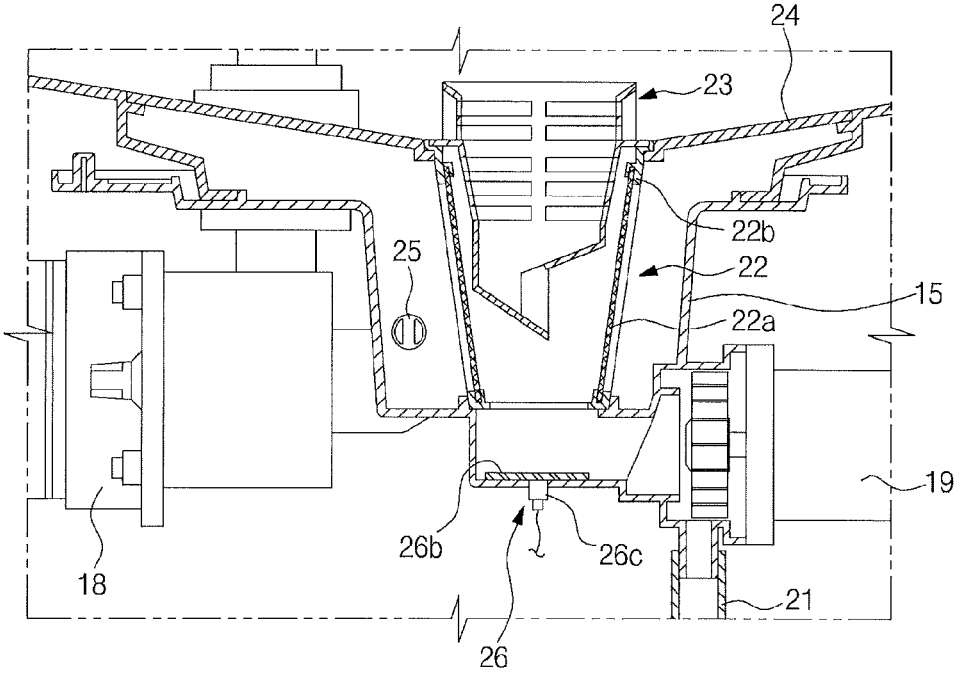
FIG. 9 is a cross-sectional view illustrating a sump of a dishwasher according to another embodiment of the present disclosure and an ultrasonic generator installed at the sump.

While the microfilter 22 is illustrated as being formed in a cylindrical shape in FIGS. 7 and 8, embodiments of the present disclosure are not limited thereto. As shown in FIG. 9, the microfilter 22 may be formed to have a diameter gradually increasing from the lower end thereof to the upper end thereof. Although not shown, the microfilter 22 may be alternatively formed to have a diameter gradually increasing from the upper end thereof to the lower end thereof.

If the diameter of the microfilter 22 gradually increases from one of the upper and lower ends thereof to the other end as above, ultrasonic waves radiating from the vibration plate 26*b* disposed at the inner lower surface of the sump 15 may be more efficiently transferred to the filter membrane 22*a* without being obstructed by the frame 22*b* of the microfilter 22, thereby allowing more efficient cleaning of the filter membrane 22*a* of the microfilter 22.

Figure 10:
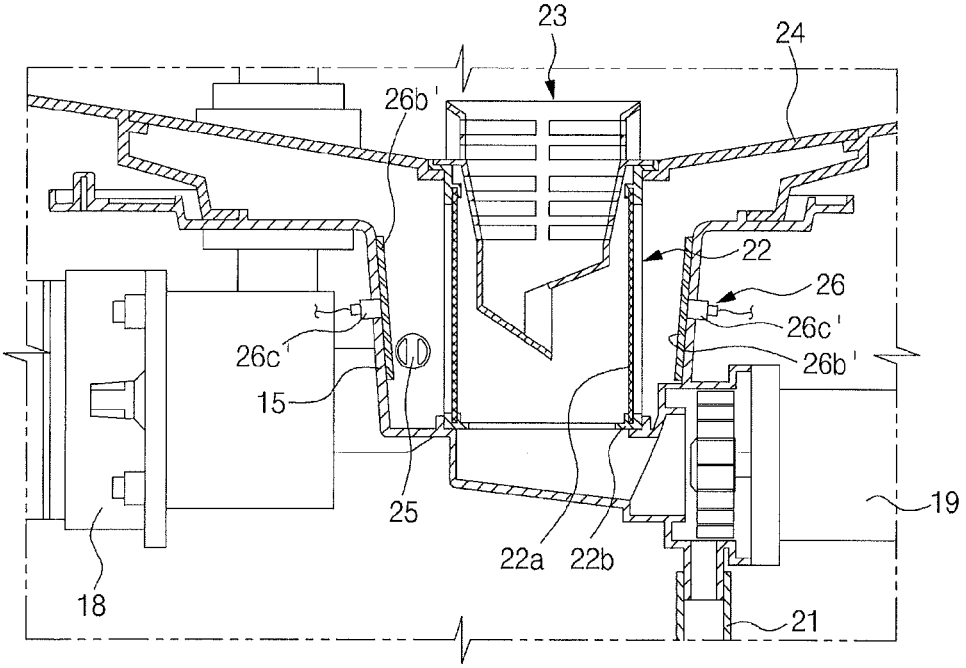
FIG. 10 is a cross-sectional view illustrating a sump of a dishwasher according to another embodiment of the present disclosure and an ultrasonic generator installed at the sump.

Alternatively, as shown in FIG. 10, the vibration plate 26*b*' may be formed in an arc shape or cylindrical shape and disposed at the inner circumferential surface of the sump 15, and the ultrasonic vibrator 26*e* may be arranged to contact the outer circumferential surface of the vibration plate 26*b*' through the lateral surface of the sump 15. In the illustrated embodiment, two ultrasonic vibrators 26*c*' are provided and arranged at opposite sides of the sump 15. Accordingly, ultrasonic waves generated by the ultrasonic vibrators 26*e* radiate through the vibration plate 26*b*' toward the microfilter 22 disposed at the radial inside of the sump 15 to clean the microfilter 22.

While the two ultrasonic vibrators 26*c*' are illustrated as being disposed at the opposite sides of a cylindrical vibration plate 26*b*', embodiments of the present disclosure are not limited thereto. Depending on the design, one or three or more ultrasonic vibrators 26*c*' may alternatively be disposed at the vibration plate 26*b*'.

Hereinafter, another embodiment of the present disclosure will be described in detail with reference to the accompanying drawings.

Figure 11:
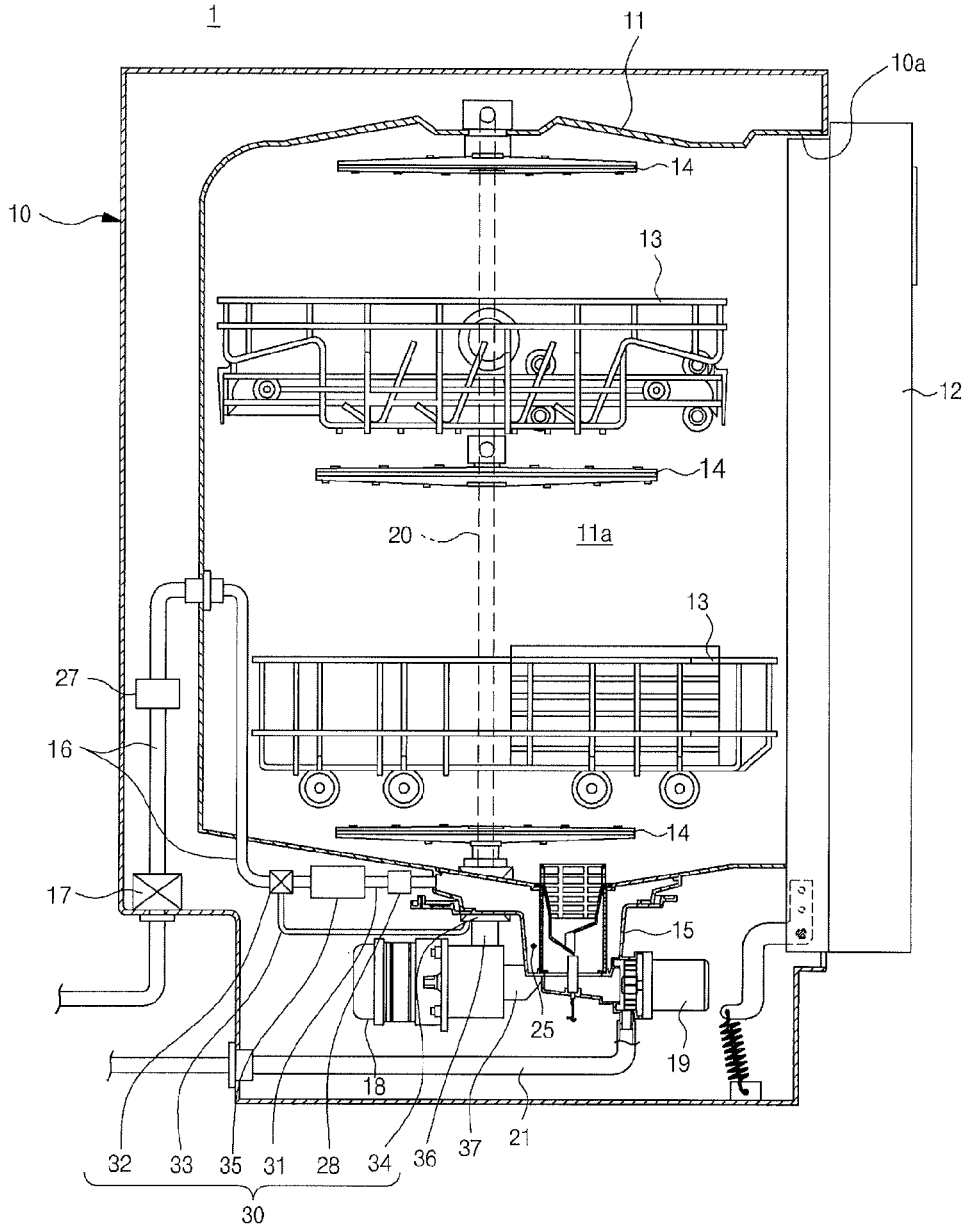
FIG. 11 is a cross-sectional view illustrating a dishwasher according to another embodiment of the present disclosure.

FIG. 11 is a cross-sectional view illustrating a dishwasher according to another embodiment of the present disclosure Referring to FIG. 11, the constituents of the dishwasher having the same reference numerals and names as those of dishwasher shown in FIG. 1 perform the same function, and thus a detailed description thereof will be omitted. Hereinafter, details of the dishwasher different from those of the dishwasher shown in FIG. 1 will be focused upon.

In the illustrated embodiment, when the dishwasher stays in a standby mode, in which it is not used, after completing main functions of washing, rinsing and drying, the function of sterilization may be performed to prevent contamination and foul odor from microorganisms proliferating in the sump.

To this end, the dishwasher according to the illustrated embodiment may further include a sump circulation module 30 including a circulation pump 18, a water temperature sensor 28, a second water supply pipe 31, a channel diversion valve 32, a sump circulation pipe 33, and a heater 35.

In the illustrated embodiment, the dishwasher 1 may supply hot water to the sump 15 through the sump circulation module 30 while performing sterilization. If hot water is supplied into the sump 15, the hot water may not only perform sterilization, but also intensify the sterilization effect produced by vibration of the ultrasonic vibrator.

In addition, the dishwasher 1 may guide the water pumped outside the sump 15 through the sump circulation module 30 to the sump 15 to circulate the water while sterilization is performed. Even if sterilization is performed by ultrasonic vibration, contaminants may be stuck to the filters 22, 23 and 24 in the sump 15. The contaminants stuck to the inside of the sump 15 or the filters 22, 23 and 24 may be separated and moved into the water by circulating the water in the sump 15 through the sump circulation module 30, sequentially along the sump circulation pipe 33, the channel diversion valve 32, and the second water supply pipe 31.

In addition, the dishwasher 1 may periodically perform sterilization to keep the sump 15 of the dishwasher 1 in a clean state.

Figure 12:
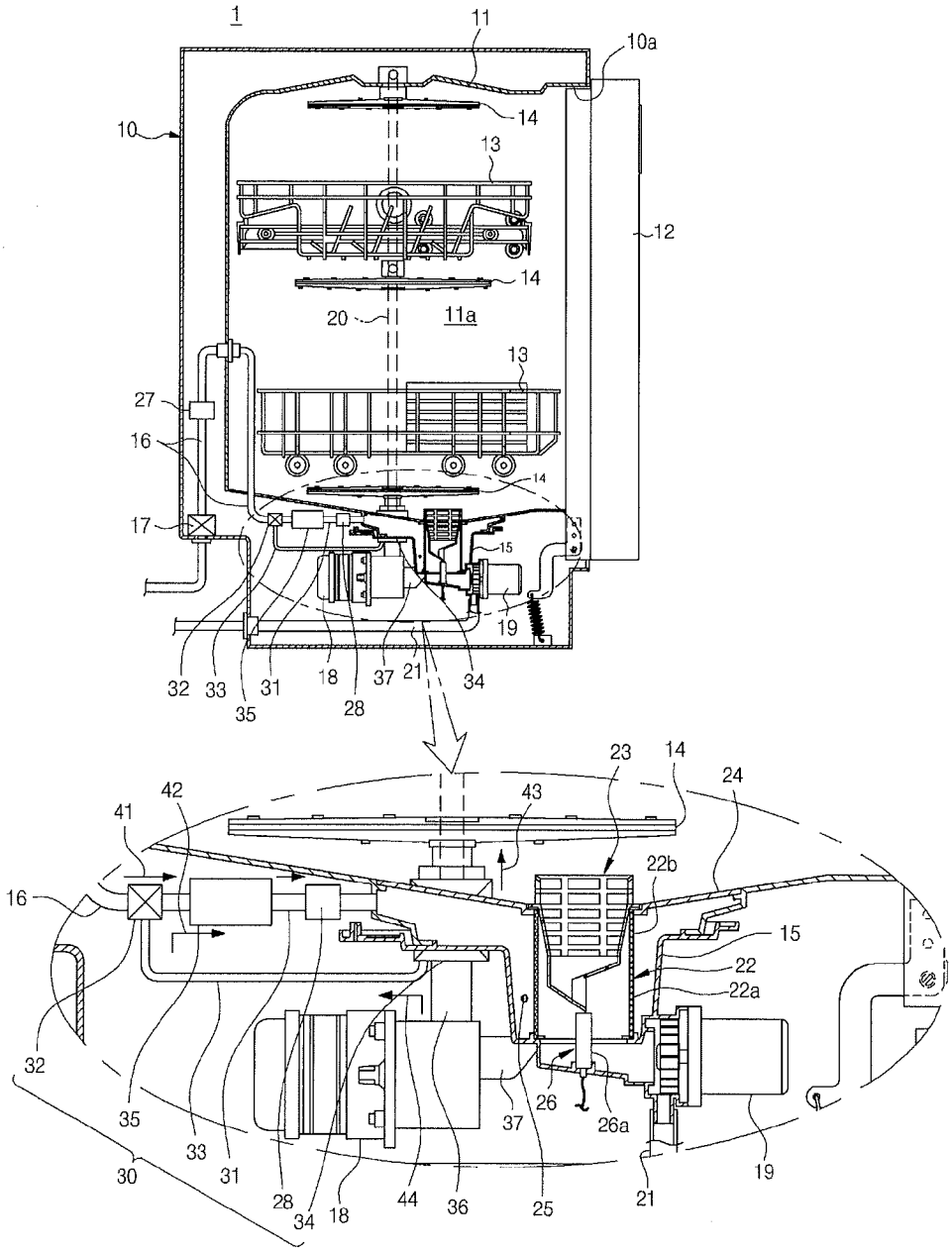
FIG. 12 is an enlarged cross-sectional view illustrating a sump circulation module of a dishwasher according to another embodiment of the present disclosure.

FIG. 12 is an enlarged cross-sectional view of a sump circulation module of a dishwasher according to another embodiment of the present disclosure.

Referring to FIG. 12, the dishwasher 1 may include a sump 15, a circulation pump 18, and a drain pump 19.

The sump 15 is disposed at the lower portion of the washing tub 11, and formed to be concave perpendicularly downward to collect water supplied through the first water supply pipe 16 or water sprayed through the nozzle 14.

The circulation pump 18 is connected to the sump to pump the water collected in the sump 15 to the outside of the sump to circulate the water by transferring the water to the nozzle 14 or the sump circulation module 30. A circulation pipe 20 to guide the water in the sump 15 to the nozzle 14 and a sump circulation pipe 33 to guide the water to the sump circulation module 30 are connected to the circulation pump 18.

The drain pump 19 discharges the water collected in the sump 15 to the outside. A drain pipe 21 to guide water in the sump 15 to the outside is connected to the drain pump 19.

Referring to FIG. 12, the dishwasher 1 may further include a microfilter 22, a coarse filter 23 and a fine filter 24.

The filters 22, 23 and 24 filter out debris contained in the water collected in the sump 15 to prevent debris larger than a specific size from being transferred to the circulation pump 18.

The microfilter 22 is formed in the shape of a cylinder which is open at the top and bottom thereof to filter out debris of a small size. The microfilter 22 includes a filter membrane 22*a* to allow water to pass therethrough and filter out fine debris contained in the water, and a frame 22*b* to maintain the cylindrical arrangement of the filter membrane 22*a* formed in the lattice pattern.

The coarse filter 23 is detachably installed at the open top of the microfilter 22 to filter out debris containing particles larger than a specific size before the debris reaches the microfilter 22.

The fine filter 24 is formed to have filter holes larger than those of the microfilter 22 and smaller than those of the coarse filter 23 and installed to cover the sump 15.

The filter membrane 22*a* of the microfilter 22 has fine tissues of a material such as fiber to filter out fine debris. If the fine debris is caught in the tissues of the filter membrane 22*a*, it may not be easily removed.

Accordingly, in the illustrated embodiment, the dishwasher 1 may further include an ultrasonic generator 26 to automatically wash the filter membrane 22*a* of the microfilter 22.

The ultrasonic generator 26 radiates ultrasonic waves toward the microfilter 22 installed at the sump 15 which is filled with water such that cavitation is produced in the water in the sump 15 by the ultrasonic waves and thereby the debris caught in the tissues of the filter membrane 22*a* of the microfilter 22 is separated from the filter membrane 22*a*.

In the illustrated embodiment of the dishwasher 1, the ultrasonic generator 26 is provided with an ultrasonic vibrator 26*a* formed in the shape of a cylinder having a smaller diameter than the microfilter 22 and disposed in the microfilter 22 through the open bottom of the microfilter 22. If the ultrasonic vibrator 26*a* of the ultrasonic generator is formed in a cylindrical shape and disposed in the microfilter 22 as described above, ultrasonic waves generated by the ultrasonic vibrator 26*a* may be radiated outward in a radial direction thereof and uniformly transferred to the entire filter membrane 22*a* of the microfilter 22 such that the entire filter membrane 22*a* may be uniformly cleaned.

Referring to FIG. 12, the dishwasher 1 may further include a turbidity sensor 25.

The turbidity sensor 25 may be disposed in the sump 15, and may measure the turbidity T of water contained in the sump 15 and transfer the same to a controller (not shown).

Referring to FIG. 12, the dishwasher 1 according to the illustrated embodiment may further include a first water supply pipe 16, a water supply valve 17, a water level sensor 27, and a sump circulation module 30.

The first water supply pipe 16 may be installed at the rear side of the washing tub 11*a*, and adapted to guide water from an external water supply source (not shown) to the sump 15. More specifically, one side of the first water supply pipe 16 may be connected to the external water supply source (not shown), and the other side of the first water supply pipe 16 may be connected to a channel diversion valve 32.

The water supply valve 17 may be disposed on the first water supply pipe 16 to the side of the external water supply source (not shown) to selectively open and close the first water supply pipe 16.

The water level sensor 27 may be disposed at the outlet of the water supply valve 17 on the first water supply pipe 16 to sense the amount of water supplied to the sump 15. For example, a flowmeter may be used as the water level sensor 27. The flowmeter is a sensor that measures the flow rate (the water level in the sump) of a fluid which rotates a turbine while passing through the flowmeter. When the water supplied from an external water supply source passes through the flowmeter, a pulse signal is generated. The signal generated by the flowmeter (information of the water level) is transmitted to the controller (not shown). However, embodiments of the preset disclosure are not limited thereto. The water level sensor 27 may have any configuration so long as sensing of the water level in the sump 15 is determined.

The sump circulation module 30 may include a water temperature sensor 28, a second water supply pipe 31, a channel diversion valve 32, a sump circulation pipe 33, a circulation control valve 34, and a heater 35. The sump circulation module 30 may supply hot water to the sump 15 and circulate the water in the sump 15 along the sump circulation pipe 33, the channel diversion valve 32 and the second water supply pipe 31.

The water temperature sensor 28 may be disposed between the heater 35 and the sump 15 to sense the temperature of water heated by the heater 35 and introduced into the sump. The temperature of water passing through the heater 35 may be viewed as the temperature of the water in the sump 15. The water temperature sensor 28 may transfer the information on the sensed temperature to the controller (not shown). However, the position of the water temperature sensor 28 is not limited thereto. The water temperature sensor 28 may be disposed at any position so long as sensing of the water level in the sump 15 is determined.

The second water supply pipe 31 may be installed at the outer lower portion of the washing tub 11*a* and may guide the water introduced thereinto from the first water supply pipe 16 or the sump circulation pipe 33 to the sump 15. More specifically, the second water supply pipe 31 may have one side connected to the channel diversion valve 32, and the other side connected to the sump 15, thereby guiding the water introduced thereinto from the first water supply pipe 16 or the sump circulation pipe 33 to the sump 15.

The channel diversion valve 32 may be installed at the outer lower portion of the washing tub 11*a* and have a first side connected to the inlet of the first water supply pipe 16 receiving water from an external water supply source, a second side connected to the inlet of the second water supply pipe 31 supplying water to the sump 15, a third side connected to the outlet of the sump circulation pipe 33 receiving the circulating water from the sump 15, thereby guiding water supplied from one of the first water supply pipe 16 and the sump circulation pipe 33 to the sump 15 through the second water supply pipe 31.

During the operation of water supply, the channel diversion valve 32 may be controlled to guide water from the first water supply pipe 16 to the sump 15 through the second water supply pipe 31. During the operation of the sump circulation, the channel diversion valve 32 may be controlled to guide water from the sump circulation pipe 33 to the sump 15 through the second water supply pipe 31.

The channel diversion valve 32 may guide the water supplied from the first water supply pipe 16 to the second water supply pipe 31 by opening a first channel 41 which connects the outlet of the first water supply pipe 16 to the inlet of the second water supply pipe 31 and closing a second channel 42 which connects the outlet of the sump circulation pipe 33 to the inlet of the second water supply pipe 31.

In addition, the channel diversion valve 32 may guide the water supplied from the sump circulation pipe 33 to the second water supply pipe 31 by closing the first channel 41 which connects the outlet of the first water supply pipe 16 to the inlet of the second water supply pipe 31 and opening the second channel 42 which connects the outlet of the sump circulation pipe 33 to the inlet of the second water supply pipe 31.

The channel diversion valve 32 may be separated into a first valve (not shown) to open or close the first channel 41 connected to the first water supply pipe 16 and a second valve (not shown) to open or close the second channel 42 connected to the sump circulation pipe 33.

The sump circulation pipe 33 may be installed at the outer lower portion of the washing tub 11*a* and may guide the water pumped by the circulation pump 18 to the outside of the sump 15 to circulate the water. One side of the sump circulation pipe 33 may be connected to the channel diversion valve 32, and the other side thereof may be connected to the circulation control valve 34 disposed at the outlet 36 of the circulation pump 18. During the operation of the sump circulation, the sump circulation pipe 33 may guide the water discharged from the circulation control valve 34 to the channel diversion valve 32. In this case, the water discharged from the circulation control valve 34 may circulate sequentially along the sump circulation pipe 33, the channel diversion valve 32, the second water supply pipe 31, and the sump 15.

The circulation control valve 34 may be installed at the outer lower portion of the washing tub 11*a* and have a first side connected to the outlet 36 of the circulation pump 18, a second side connected to the inlet of the circulation pipe 20 which guides the water in the sump to the nozzle 14, and a third side connected to the inlet of the sump circulation pipe 33, thereby guiding the water pumped by the circulation pump 18 to one of the circulation pipe 20 and the sump circulation pipe 33.

The circulation control valve 34 may guide the water pumped out of the sump 15 to the circulation pipe 20 by opening a third channel 43 which connects the outlet 36 of the circulation pump 18 to the inlet of the circulation pipe 20 and closing a fourth channel 44 which connects the outlet of the circulation pump 18 to the inlet of the sump circulation pipe 33.

In addition, the circulation control valve 34 may guide the water pumped out of the sump 15 to the sump circulation pipe 33 by closing the third channel 43 which connects the outlet 36 of the circulation pump 18 to the inlet of the circulation pipe 20 and opening the fourth channel 44 which connects the outlet of the circulation pump 18 to the inlet of the sump circulation pipe 33.

The heater 35 may be installed on the second water supply pipe 31 at the outer lower portion of the washing chamber 11*a* and heat water flowing through the second water supply pipe. Once the hot water heated by the heater 35 is supplied to the sump 15, the hot water may dissolve debris present in the sump 15 and on the filters 22, 23 and 24 or eliminate microorganisms. For the dishwasher 1, if hardened debris is stuck to the inside of the sump 15 or to the filters 22, 23 and 24, it may not be sufficiently removed with common cool water. In such a case, if water heated by the heater 35 is supplied to the sump 15, the hot water may soften the debris stuck to the inside of the sump 15 or to the filters 22, 23 and 24 and facilitate separation of the debris from the inside of the sump 15 or the filters 22, 23 and 24. In addition, if the temperature is out of the optimum range for proliferation of microorganisms, the reproduction rate of microorganisms is lowered. Thus, if water heated by the heater 35 to a temperature higher than the highest temperature within the optimum range for proliferation of microorganisms is supplied to the sump 15, the hot water may eliminate microorganisms present in the sump 15 or at the filters 22, 23 and 24.

In addition, as the water heated by the heater 35 is combined with the ultrasonic waves radiated from the ultrasonic generator 26, the effects of dissolution of the debris present in the sump 15 or at the filters 22, 23 and 24 and sterilization may be intensified. The ultrasonic generator 26 radiates ultrasonic waves toward the sump 15 to allow the ultrasonic waves to produce cavitation in the water in the sump 15. Cavitation, which refers to a phenomenon of creation of fine bubbles due to a large change in pressure of ultrasonic waves, occurs along with high pressure and high temperature. The high pressure and high temperature are produced in short pulses between one hundredth of a second and one ten-thousandth of a second. The strong force produced by the high pressure and high temperature may distribute and dissolve the debris and maximize elimination of the microorganisms.

When water heated by the heater 35 is first supplied to the sump 15, the debris stuck to the inside of the sump 15 or to the filters 22, 23 and 24 is softened. Under this condition, if ultrasonic waves are radiated from the ultrasonic generator 26, the debris may be more easily separated from the inside of the sump 15 or the filters 22, 23 and 24.

In addition, if ultrasonic waves are radiated from the ultrasonic generator 26 toward the sump 15 with the water heated by the heater 35 supplied, higher pressure and higher temperature may be produced by cavitation, securing more effective sterilization of eliminating the microorganisms present in the sump 15 or at the filters 22, 23 and 24.

Figure 13A:
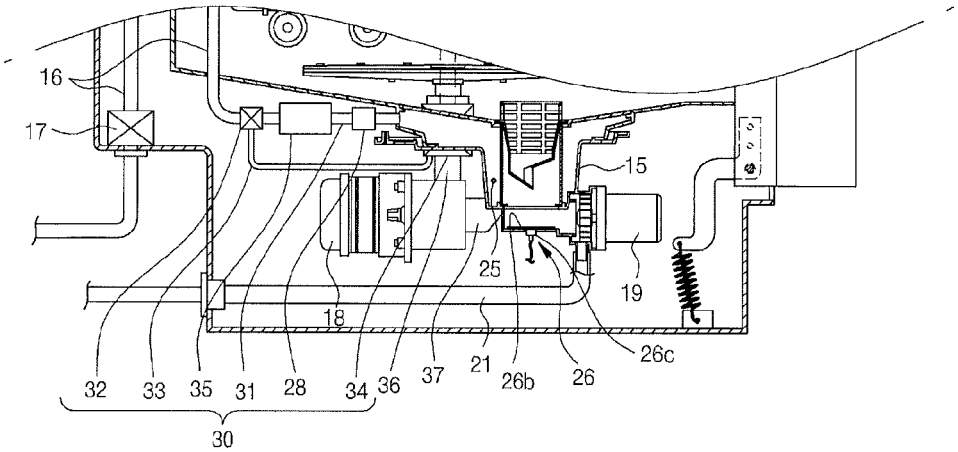
FIGS. 13A to 13C are cross-sectional views illustrating an ultrasonic generator and a sump circulation module installed at a sump of a dishwasher according to another embodiment of the present disclosure.
Figure 13B:
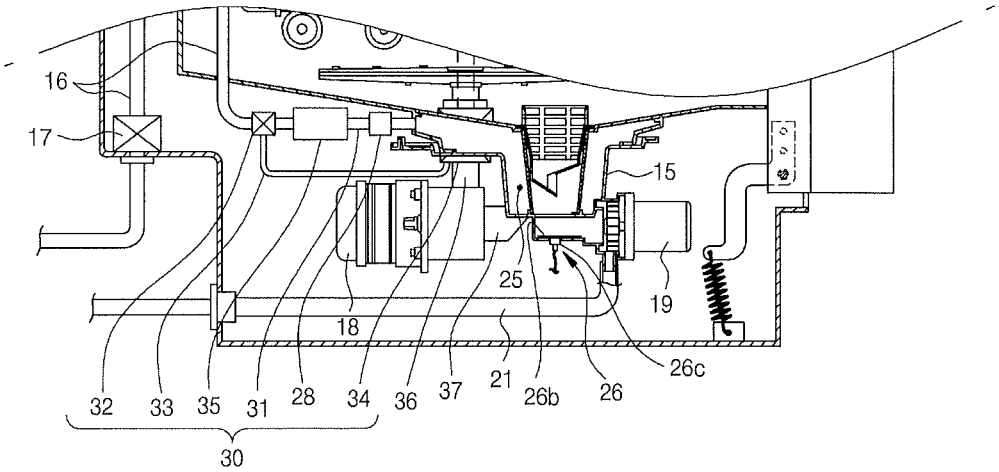
Figure 13C:
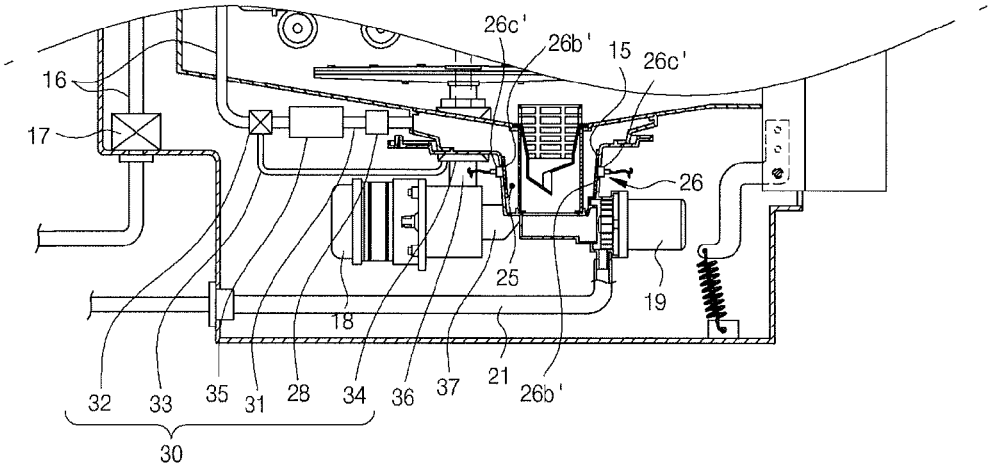

FIGS. 13A to 13C are cross-sectional views illustrating an ultrasonic generator and a sump circulation module installed at a sump of a dishwasher according to another embodiment of the present disclosure.

The ultrasonic generator 26 shown in FIGS. 13A to 13C includes a vibration plate 26*b*, 26*b*' formed of metal, and an ultrasonic vibrator 26*c*, 26*c*' disposed such that one surface thereof contacts the vibration plate 26*b*, 26*b*'. The ultrasonic generator 26 configured as above allows ultrasonic waves generated by the ultrasonic vibrator 26*a* to be transferred to the vibration plate 26*b*, 26*b*' such that the ultrasonic waves are radiated toward the microfilter 22 through the vibration plate 26*b*, 26*b*'.

In addition, the sump circulation module 30 shown in FIGS. 13A to 13C may include a water temperature sensor 28, a second water supply pipe 31, a channel diversion valve 32, a sump circulation pipe 33, a circulation control valve 34, and a heater 35.

In the illustrated embodiment, the dishwasher 1 is provided with both the ultrasonic generator 26 and the sump circulation module 30, and thus may more easily separate debris stuck to the inside of the sump 15 or the filters 22, 23 and 24. Moreover, the dishwasher 1 may more effectively eliminate microorganisms present in the sump 15 or at the filters 22, 23 and 24.

Referring to FIGS. 13A and 13B, the vibration plate 26*b* is formed in the shape of a circular disc and disposed at the inner lower surface of the sump 15. The ultrasonic vibrator 26*c* is arranged through the lower surface of the sump 15 and the upper surface thereof is adapted to contact the lower surface of the vibration plate 26*b*. Accordingly, the ultrasonic waves generated by the ultrasonic vibrator 26*c* are radiated toward the microfilter 22 disposed at the upper side of the ultrasonic vibrator 26*c* through the vibration plate 26*b* to clean the microfilter 22.

While the microfilter 22 shown in FIG. 13A is illustrated as being formed in a cylindrical shape, embodiments of the present disclosure are not limited thereto. As shown in FIG. 13B, the microfilter 22 may be formed to have a diameter gradually increasing from the lower end thereof to the upper end thereof. Although not shown, the microfilter 22 may be alternatively formed to have a diameter gradually increasing from the upper end thereof to the lower end thereof.

If the diameter of the microfilter 22 gradually increases from one of the upper and lower ends thereof to the other end as above, ultrasonic waves radiating from the vibration plate 26*b* disposed at the inner lower surface of the sump 15 may be more efficiently transferred to the filter membrane 22*a* without being obstructed by the frame 22*b* of the microfilter 22, thereby allowing more efficient cleaning of the filter membrane 22*a* of the microfilter 22.

Alternatively, as shown in FIG. 13C, the vibration plate 26*b*' may alternatively be formed in an arc shape or cylindrical shape and disposed at the inner circumferential surface of the sump 15, and the ultrasonic vibrator 26*c*' may be arranged to contact the outer circumferential surface of the vibration plate 26*b*' through the lateral surface of the sump 15. In the illustrated embodiment, two ultrasonic vibrators 26*e* are provided and arranged at opposite sides of the sump 15. Accordingly, ultrasonic waves generated by the ultrasonic vibrators 26*c*' radiate through the vibration plate 26*b*' toward the microfilter 22 disposed at the radial inside of the sump 15 to clean the microfilter 22.

While the two ultrasonic vibrators 26*c*' is illustrated as being disposed at the opposite sides of a cylindrical vibration plate 26*b*', embodiments of the present disclosure are not limited thereto. Depending on design, one or three or more ultrasonic vibrators 26*e* may alternatively be disposed at the vibration plate 26*b*'.

Figure 14:
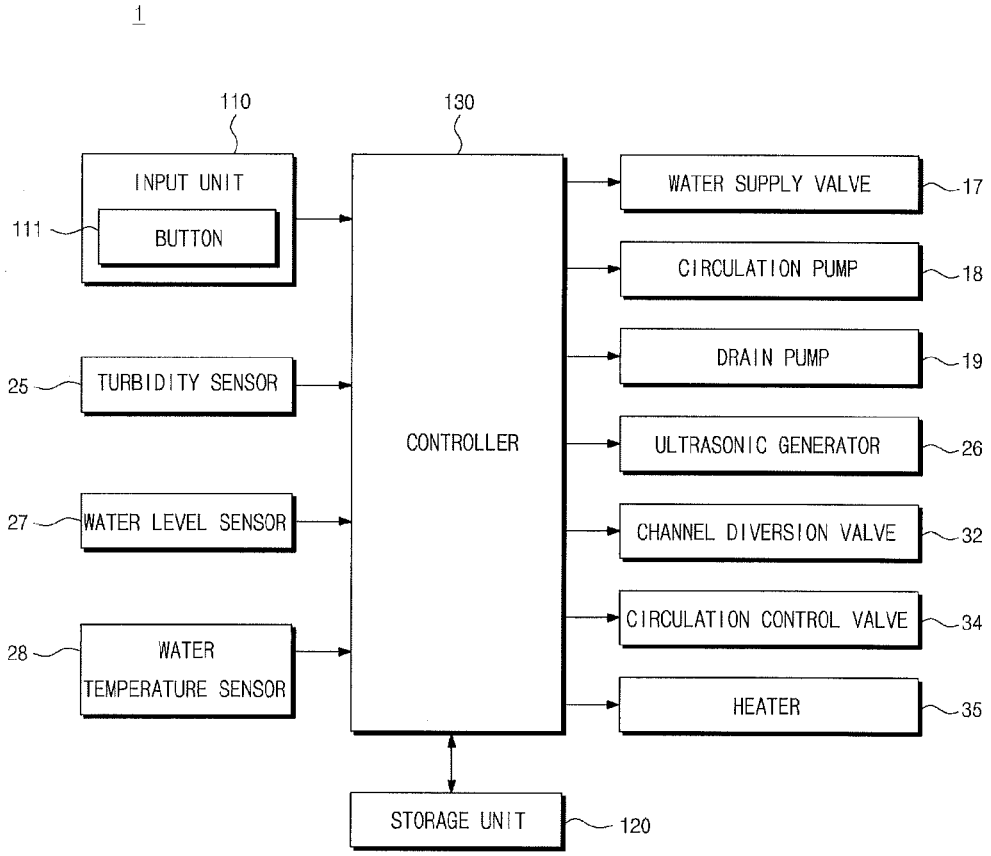
FIG. 14 is a control block diagram illustrating a dishwasher according to another embodiment of the present disclosure.

FIG. 14 is a control block diagram illustrating a dishwasher according to another embodiment of the present disclosure.

Referring to FIG. 14, the dishwasher 1 according the illustrated embodiment may include a water supply valve 17, a circulation pump 18, a drain pump 19, an ultrasonic generator 26, a channel diversion valve 32, a circulation control valve 33, a heater 35, an input unit 110, a turbidity sensor 25, a water level sensor 27, a water temperature sensor 28, a storage unit 120, and a controller 130.

The dishwasher 1 sprays wash water onto dishes contained in the washing tub 11 of the dishwasher 1 to separate foreign substances from the dishes and remove the same. In addition, the dishwasher 1 may sterilize the washed dishes, the inside of the washing tub 11, and the sump 15.

The water supply valve 17 is connected to the output side of the controller 130 and may selectively open and close the first water supply pipe 16.

The circulation pump 18 is connected to the output side of the controller 130, and may transfer the water collected in the sump 15 to the nozzle 14 or the sump circulation module 30 to circulate the water.

The drain pump 19 is connected to the output side of the controller 130, and may discharge water collected in the sump 15 to the outside.

The ultrasonic generator 26 is connected to the output side of the controller 130, and may radiate ultrasonic waves toward the sump 15 or the microfilter.

The channel diversion valve 32 is connected to the output side of the controller 130, and may open or close the first channel 41 connecting the first water supply pipe 16 to the second water supply pipe 31. When the channel diversion valve 32 opens the first channel 41, the water introduced from an external water supply source (not shown) flows into the sump 15 sequentially through the first water supply pipe 16 and the second water supply pipe 31.

In addition, the channel diversion valve 32 may open or close the second channel 42 connecting the sump circulation pipe 33 to the second water supply pipe 31 while opening or closing of the first channel connecting the first water supply pipe 16 to the second water supply pipe 31. If the channel diversion valve 32 opens the second channel 42, the water introduced from the sump 15 flows sequentially through the sump circulation pipe 33 and the second water supply pipe 31 and then into the sump 15 again.

The circulation control valve 34 is connected to the output side of the controller 130, and may open or close the third channel 43 connecting the outlet 36 of the circulation pump 18 to the circulation pipe 20. If the circulation control valve 34 opens the third channel 43, the water introduced from the outlet 36 of the circulation pump 18 flows sequentially through the circulation pipe 20 and the nozzle 14 and then into the sump 15.

In addition, the circulation control valve 34 may open or close the fourth channel 44 connecting the outlet 36 of the circulation pump 18 to the sump circulation pipe 33 upon opening or closing the third channel 43 connecting the outlet 36 of the circulation pump 18 to the circulation pipe 20. When the circulation control valve 34 opens the fourth channel 44, the water introduced from the outlet 36 of the circulation pump 18 flows sequentially through the sump circulation pipe 33 and the second water supply pipe 31 and then into the sump 15 again.

The heater 35 connected to the output side of the controller 130 may be installed on the second water supply pipe 31 at the outer lower portion of the washing chamber 11*a* to heat water flowing through the second water supply pipe.

The input unit 110 is connected to the input side of the controller 130 to receive information from a user. The input unit 110 may be provided with a plurality of buttons 111 and may transfer input information corresponding to a button pressed by the user to the controller 130. The input unit 110 may receive information on the operations of washing, rinsing, drying, and sterilization from the user.

The turbidity sensor 25 may be disposed in the sump 15, and may measure the turbidity T of water contained in the sump 15 and transfer the same to a controller (not shown).

The water level sensor 27 is connected to the input side of the controller 130, and may sense the amount (level) of water supplied to the sump 15. For example, a flowmeter may be used as the water level sensor 27. The flowmeter is a sensor that measures the flow rate (the water level in the sump) of a fluid which rotates a turbine while passing through the flowmeter. When the water supplied from an external water supply source passes through the flowmeter, a pulse signal is generated. The signal generated by the flowmeter (information of the water level) is transmitted to the controller (not shown). However, embodiments of the preset disclosure are not limited thereto. The water level sensor 27 may have any configuration so long as sensing of the level of the wash water in the sump 15 is determined.

The water temperature sensor 28 is connected to the input side of the controller 130, and may sense the temperature of water in the sump 15. For example, the water temperature sensor 28 may be installed between the heater 35 and the sump 15 and sense the temperature of water having passed through the heater 35. The temperature of water having passed through the heater 35 may be viewed as the temperature of the water in the sump 15. The water temperature sensor 28 may transfer the information on the sensed temperature to the controller (not shown). However, the position of the water temperature sensor 28 is not limited thereto. The water temperature sensor 28 may be disposed at any position so long as sensing of the temperature of the wash water in the sump 15 is allowed.

The storage unit 120 provides a space to store computer code and data generally used by the dishwasher 1. For example, the storage unit 120 may be a read only memory (ROM), random access memory (RAM), hard disk drive and/or the like.

Various commands, water level information, temperature information, reference water level, a first reference time, and a second reference time may be stored in the storage unit 120.

The controller 130 may execute commands and carry out operations related to the dishwasher. For example, using a command retrieved from the storage unit 120, the controller 130 may control reception and processing of input and output data among constituents of the dishwasher 1. The controller 130 may be realized as a single chip, plural chips, or plural electric components.

The controller 130 may carry out main operations of washing, rinsing and drying. Then, the controller 130 may drive the ultrasonic generator and the heater based on the water level information received from the water level sensor and temperature information received from the water temperature sensor to carry out sterilization in which the inside of the sump 15 and the filter are sterilized.

In addition, the controller 130 may control the water supply valve 17 to guide water supplied from an external water supply source (not shown) to the sump 15 through the first water supply pipe 16.

The controller 130 may control the channel diversion valve 32 to open the first channel 41. When the controller 130 opens the first channel 41, the water introduced from the external water supply source (not shown) may flow sequentially through the first water supply pipe 16 and the second water supply pipe 31 and then into the sump 15.

In addition, the controller 130 may control the heater 35 to heat the water supplied to the sump 15 to a predetermined reference water temperature. Here, the predetermined reference water temperature may include a temperature higher than that of the water supplied from the external water supply source (not shown) or a temperature higher than the highest temperature allowing reproduction of microorganisms.

The controller 130 may receive the water level information from the water level sensor 27 and sense the water level in the sump 15. If the water level in the sump 15 is higher than a predetermined reference water level, the controller 130 may control the water supply valve 17 to stop supply of water. If the water level in the sump 15 is lower than the predetermined reference water level, the controller 130 may control the water supply valve 17 to allow water to continue to be supplied.

Here, the predetermined reference water level refers to a water level in the sump 15 that allows the controller 130 to perform sterilization. For example, the predetermined reference water level may include a water level at which the microfilter 22 installed in the sump 15 is submerged.

The controller 130 may also receive water temperature information from the water temperature sensor 28 and sense the water temperature in the sump 15. When the water is supplied to the sump 15, the water is heated by the heater 35 and introduced into the sump 15. However, depending on the output power of the heater 35, the temperature of the water may not reach the reference water temperature.

In the case that the water temperature in the sump 15 is lower than the predetermined reference water temperature, the controller 130 may control the circulation pump 18, the channel diversion valve 32 and the sump circulation pipe 33 to circulate the water in the sump 15 through the sump circulation module 30, heating the water. Here, the reference water temperature refers to a water temperature in the sump 15 that allows the controller 130 to perform sterilization. For example, the reference water temperature may include a temperature higher than that of the water supplied from the external water supply source (not shown) or a temperature higher than the highest temperature allowing reproduction of microorganisms. The highest temperature allowing reproduction of microorganisms may be about 70 degrees Celsius.

At this time, the controller 130 controls the circulation control valve 34 to close the third channel 43 and open the fourth channel 44. In addition, the controller 130 controls the channel diversion valve 32 to close the first channel 41 and open the second channel 42. When the second channel 42 and the third channel 43 are opened, the water introduced from the outlet 36 of the circulation pump 18 flows sequentially through the sump circulation pipe 33, the channel diversion valve 32, the heater 35 and the second water supply pipe 31 and then into the sump 15. The controller 130 may control the heater 35 to continue to heat the water circulating through the sump circulation module 30.

If the water temperature in the sump 15 is greater than or equal to the predetermined reference water temperature, the controller 130 may control the heater 35 to stop heating the water.

While the controller 130 is illustrated above as heating the water while supplying the water to the sump 15, embodiments of the present disclosure are not limited thereto. Any control method may be used so long as the water in the sump 15 is adjustable to the reference water temperature and reference water level. For example, the controller 130 may first perform supply of water to the sump 15 up to the reference water level and then heat the water in the sump 15 to the reference water temperature while circulating the water through the sump circulation module 30.

When the water in the sump 15 reaches the reference water level and the reference water temperature, the controller 130 may control the ultrasonic generator to radiate ultrasonic waves, thereby cleaning and sterilizing the inside of the sump 15 and the filters 22, 23 and 24.

Further, the controller 130 may determine if the duration of operation of the ultrasonic generator has reached a first predetermined reference time. Here, the first reference time is a predetermined time long enough to allow the inside of the sump 15 and the filters 22, 23 and 24 to be sufficiently cleaned and sterilized. For example, the first reference time may include a time until the concentration of the microorganisms in the sump 15 becomes less than or equal to 1 log (CFU/mL).

When the duration of operation of the ultrasonic generator has not reached the first predetermined reference time, the controller 130 may continue to perform cleaning and sterilizing of the inside of the sump 15 and the filters 22, 23 and 24.

When the duration of operation of the ultrasonic generator has reached the first predetermined reference time, the controller 130 may stop operation of the ultrasonic generator 26 such that the ultrasonic generator 26 does not radiate ultrasonic waves.

The controller 130 may further control the drain pump 19 to discharge the water containing microorganisms or debris in the sump 15 to the outside.

In addition, to completely eliminate residues, the controller 130 may re-supply clean water to the sump 15 to a predetermined reference water level and circulate the water in the sump 15 through the sump circulation module 30 multiple times to cause residues to be separated from the sump 15 and moved into the water in the sump 15. Then, the controller 130 may drain the water re-supplied to the sump 15 and terminate the sterilization operation. The controller 130 may repeatedly carry out re-supply, circulation and drainage of water multiple times.

When the controller 130 receives a signal for operation of main functions from the user in the standby mode after terminating the sterilization operation, the controller 130 may start performing the main functions of washing, rinsing and drying. In case that the controller 130 receives no signal from the user in the standby mode, the controller 130 may determine if a second reference time has elapsed since termination of sterilization.

In a case where the second reference time has not elapsed since termination of sterilization, the controller 130 may remain in the standby mode. In case that the second reference time has elapsed since termination of sterilization, the controller 130 may terminate the standby mode and resume the sterilization operation. Here, the second reference time, which is a period of repetition of the sterilization operation, represents a predetermined time from the moment the sterilization operation is terminated until the sterilization operation is performed again.

Figure 15A:
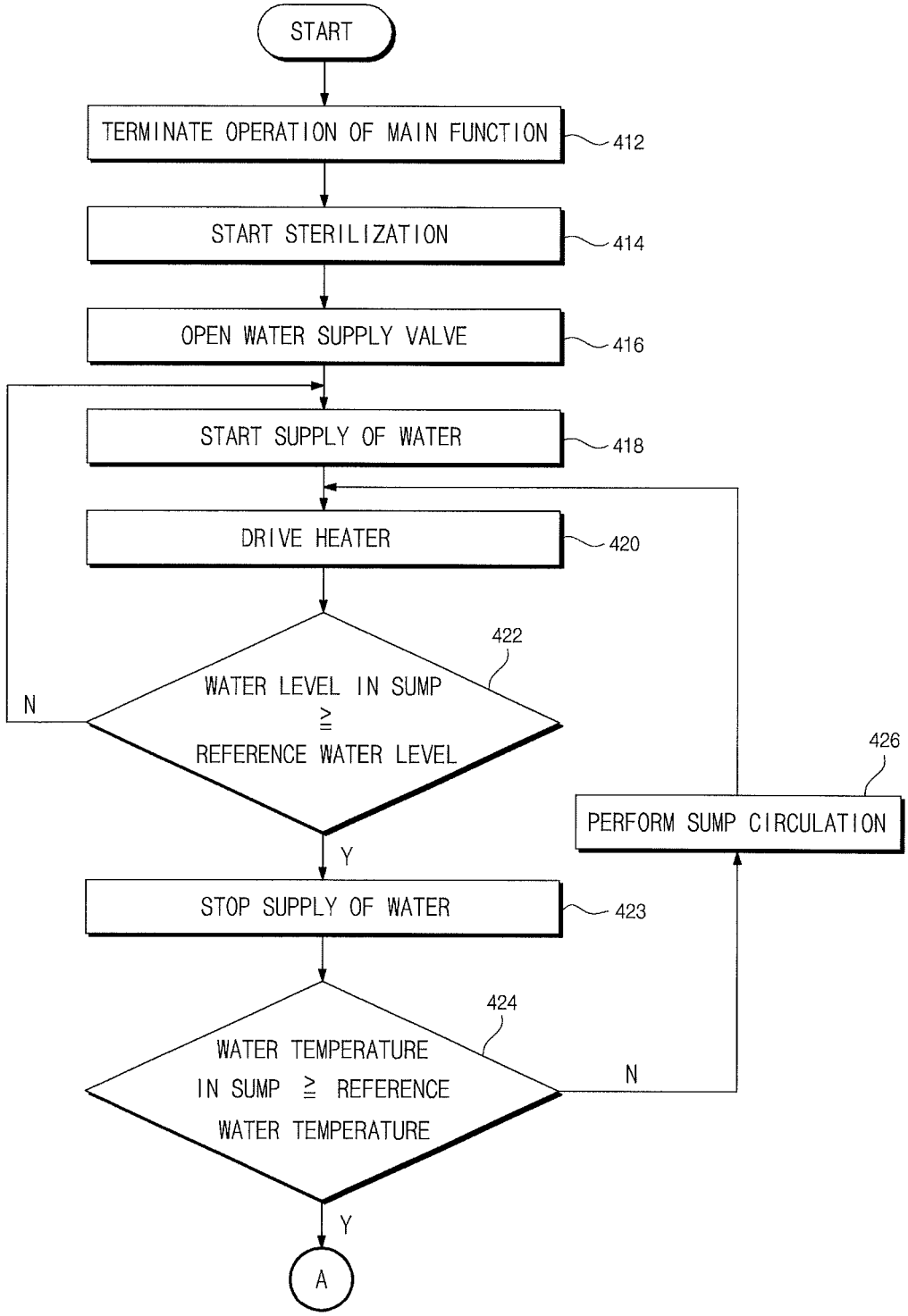
FIGS. 15A and 15B are flowcharts illustrating the sterilization operation performed by a dishwasher according to another embodiment of the present disclosure.
Figure 15B:
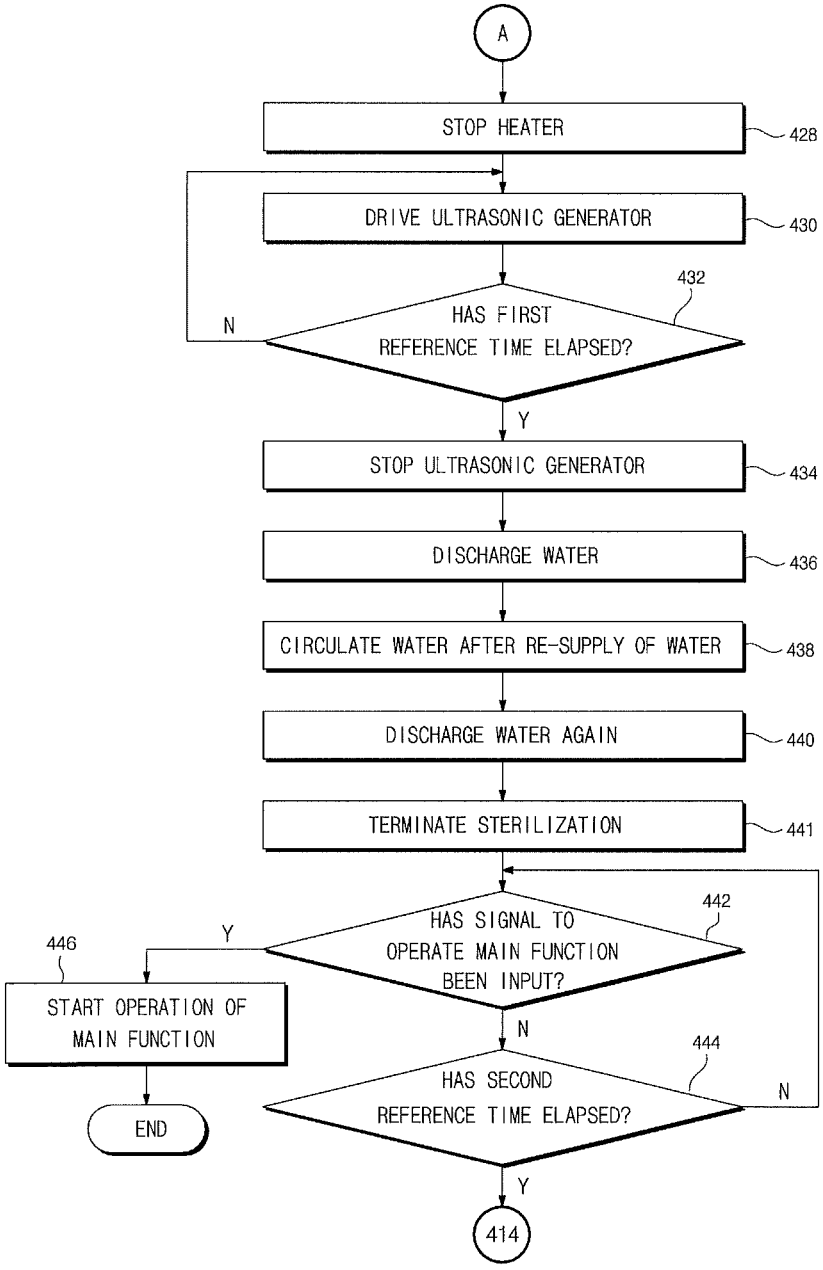

FIGS. 15A and 15B are flowcharts illustrating the sterilization operation performed by a dishwasher according to another embodiment of the present disclosure.

Referring to FIGS. 14, 15A and 15B, the dishwasher 1 performs main functions of washing, rinsing and drying. During washing operation, the dishwasher 1 circulates detergent mixed with hot water to wash the dishes. When the washing operation is completed, rinsing operation is performed to eliminate remaining detergent and contaminants from the surfaces of the dishes. After the rinsing operation is completed, drying operation is performed by circulating hot air in the dishwasher 1 to remove water from the surfaces of the dishes.

After carrying out all the operations of washing, rinsing and drying, the dishwasher 1 terminates performance of the main functions (412).

Then, the dishwasher 1 may start the sterilization operation of sterilizing the inside of the sump 15 (414). The sterilization operation may be started after the dishes are withdrawn by the user from the dishwasher 1, or may be started with the dishes present in the dishwasher 1.

First, the dishwasher 1 opens the water supply valve 17 (416).

When the water supply valve 17 is opened, water introduced from the external water supply source (not shown) is guided to the sump 15 through the first water supply pipe 16.

When the dishwasher 1 controls the channel diversion valve 32 and opens the first channel 41, the water introduced from the external water supply source (not shown) flows sequentially through the first water supply pipe 16 and the second water supply pipe 31 and then into the sump 15. The dishwasher 1 supplies the water introduced from the external water supply source to the sump 15 up to a predetermined reference water level (Operation 418).

Then, the dishwasher 1 drives the heater 35 (Operation 420). Once the heater 35 installed on the second water supply pipe 31 is driven, the heater 35 heats the water supplied to the sump 15 to a predetermined reference temperature. Heated hot water is collected in the sump 15.

Then, the dishwasher 1 senses the level of water in the sump 15 through the water level sensor 27. If the water level in the sump 15 is higher than or equal to the predetermined reference water level ("Y" in Operation 422), the dishwasher 1 proceeds to "Operation 423" and stops supply of water (Operations 422 and 423). If the water level in the sump 15 is lower than the predetermined reference water level, ("N" in Operation 422), the dishwasher 1 proceeds to "Operation 418" and allows heated water to continue to be supplied into the sump 15 (Operations 422 and 418).

Here, the reference water level refers to a predetermined water level in the sump 15 allowing the dishwasher 1 to perform the sterilization operation. For example, the reference water level may include a water level at which the microfilter 22 installed in the sump 15 is submerged.

When the water in the sump 15 reaches the reference water level, the dishwasher 1 adjusts the water supply valve 17 and stops supply of water into the sump 15 (Operation 423).

When the water is supplied to the sump 15, the water is heated by the heater 35 and introduced into the sump 15. However, depending on the output power of the heater 35, the temperature of the water may not reach the reference water temperature. In this case, the dishwasher 1 may circulate the water in the sump 15 through the sump circulation module 30, while additionally heating the water in order to raise the temperature of water in the sump 15 to the reference water temperature. At this time, the dishwasher 1 senses the temperature of the water in the sump 15 through the water temperature sensor 28.

If the water temperature in the sump 15 is lower than a predetermined reference water temperature ("N" in Operation 424), the dishwasher 1 may proceed to "Operation 426" and circulate the water in the sump 15 through the sump circulation module 30, continuing to heat the water (Operations 424 and 426).

Here, the reference water temperature refers to a predetermined water temperature in the sump 15 that allows the dishwasher 1 to perform the sterilization operation. For example, the reference water temperature may include a temperature higher than that of the water supplied from the external water supply source (not shown) or a temperature higher than the highest temperature allowing reproduction of microorganisms.

If the temperature of the water in the sump 15 is lower than the reference water temperature ("N" in Operation 424), the dishwasher 1 controls the circulation pump 18 and circulates the water in the sump 15 through the sump circulation module 30 (Operation 426). At this time, the dishwasher 1 controls the circulation control valve 34 to close the third channel 43 and open the fourth channel 44. In addition, the dishwasher 1 controls the channel diversion valve 32 to close the first channel 41 and open the second channel 42. When the second channel 42 and the third channel 43 are opened, the water introduced from the outlet 36 of the circulation pump 18 flows sequentially through the sump circulation pipe 33, the channel diversion valve 32, the heater 35 and the second water supply pipe 31 and then into the sump 15. The dishwasher 1 may control the heater 35 to continue to heat the water circulating through the sump circulation module 30.

If the temperature of the water in the sump 15 is higher than or equal to the predetermined reference water temperature ("Y" in Operation 424), the dishwasher 1 proceeds to "Operation 428" and stops the heater 35 to stop heating the water (Operations 424 and 428).

While the dishwasher 1 is illustrated above as heating water while supplying the water to the sump 15, embodiments of the present disclosure are not limited thereto. Any control method may be used so long as the water in the sump 15 is adjustable to the reference water temperature and the reference water level. For example, the dishwasher 1 may first perform supply of water to the sump 15 up to the reference water level and then heat the water in the sump 15 to the reference water temperature while circulating the water through the sump circulation module 30.

When the water in the sump 15 satisfies the reference water level and the reference water temperature, the dishwasher 1 may drive the ultrasonic generator, thereby cleaning and sterilizing the inside of the sump 15 and the filters 22, 23 and 24 (Operation 430). At this time, the dishwasher 1 may radiate ultrasonic waves toward the microfilter for the first reference time.

When the water temperature in the sump 15 is higher than the highest temperature allowing reproduction of microorganisms, microorganisms present in the sump 15 or at the filters 22, 23 and 24 may be eliminated through sterilization.

In addition, when the water heated by the heater 35 is supplied to the sump 15, contaminants stuck to the inside of the sump 15 or the filters 22, 23 and 24 become softened. When ultrasonic waves are radiated toward the sump 15 by the ultrasonic generator 26 with the contaminants softened, the contaminants stuck to the inside of the sump 15 or the filters 22, 23 and 24 may be more easily separated.

Further, when ultrasonic waves are radiated toward the sump 15 by the ultrasonic generator 26 with the sump 15 supplied with water heated by the heater 35, higher pressure and higher temperature are produced due to cavitation, and thereby the microorganisms present in the sump 15 or at the filters 22, 23 and 24 may be more effectively eliminated through sterilization.

Then, the dishwasher 1 determines if the duration of operation of the ultrasonic generator has reached a first predetermined reference time (Operation 432). Here, the first predetermined reference time includes a time until the concentration of the microorganisms in the sump 15 becomes less than or equal to 1 log (CFU/mL).

When the duration of operation of the ultrasonic generator has not reached the first reference time ("N" in Operation 432), the dishwasher 1 proceeds to "Operation 430" to continue to clean and sterilize the inside of the sump 15 and the filters 22, 23 and 24 (Operations 432 and 430).

When the duration of operation of the ultrasonic generator has reached the first reference time ("Y" in Operation 432), the dishwasher 1 proceeds to "Operation 434" to stop operation of the ultrasonic generator 26 (Operations 432 and 434).

When the dishwasher 1 drives the ultrasonic generator 26 for the first reference time, microorganisms or debris stuck to the inside of the sump 15 and the filters 22, 23 and 24 are separated and moved into the water in the sump 15.

Then, the dishwasher 1 controls the drain pump 19 to discharge the water containing microorganisms or debris in the sump 15 to the outside (Operation 436).

Even after the dishwasher 1 has discharged the contaminated water to the outside, residue may remain in the sump 15. Accordingly, to completely eliminate such residue, the dishwasher 1 re-supplies water introduced from an external water supply source to the sump 15 up to a predetermined reference water level and circulates the water in the sump 15 through the sump circulation module 30 multiple times to cause the residue to be separated from the sump 15 and moved into the water in the sump 15 (Operation 438).

Then, the dishwasher 1 drains the water re-supplied to the sump 15 (Operation 440).

While FIG. 15B illustrates that re-supply, circulation and discharge of water are performed once, embodiments of the present disclosure are not limited thereto. The dishwasher 1 may repeatedly perform re-supply, circulation and discharge of water multiple times.

After all the water in the sump 15 is drained, the dishwasher 1 terminates the sterilization operation (Operation 441).

After terminating the sterilization operation, the dishwasher 1 enters the standby mode. When the dishwasher 1 receives a signal for operation of main functions from the user in the standby mode ("Y" in Operation 442), the dishwasher 1 starts performing the main functions of washing, rinsing and drying (Operations 442 and 446). In case that the dishwasher 1 receives no signal from the user in the standby mode ("N" in Operation 442), the dishwasher 1 proceeds to "Operation 444" (Operations 442 and 444).

Then, the dishwasher 1 determines if the second reference time has elapsed since termination of sterilization (Operation 444). In case that the second reference time has not elapsed since termination of sterilization, ("N" in Operation 444), the dishwasher 1 proceeds to "Operation 442" and maintains the standby mode (Operations 444 and 442). In case that the second reference time has elapsed since termination of sterilization ("Y" in Operation 444), the dishwasher 1 terminates the standby mode and proceeds to "Operation 414" to resume the sterilization operation (Operations 444 and 414).

Here, the second reference time, which is a period of repetition of the sterilization operation by the dishwasher 1, represents a predetermined time from the moment the sterilization operation is terminated until the sterilization operation is performed again. Thereby, the dishwasher 1 of the illustrated embodiment periodically implements the sterilization operation to keep the inside of the dishwasher clean.

Figure 16:
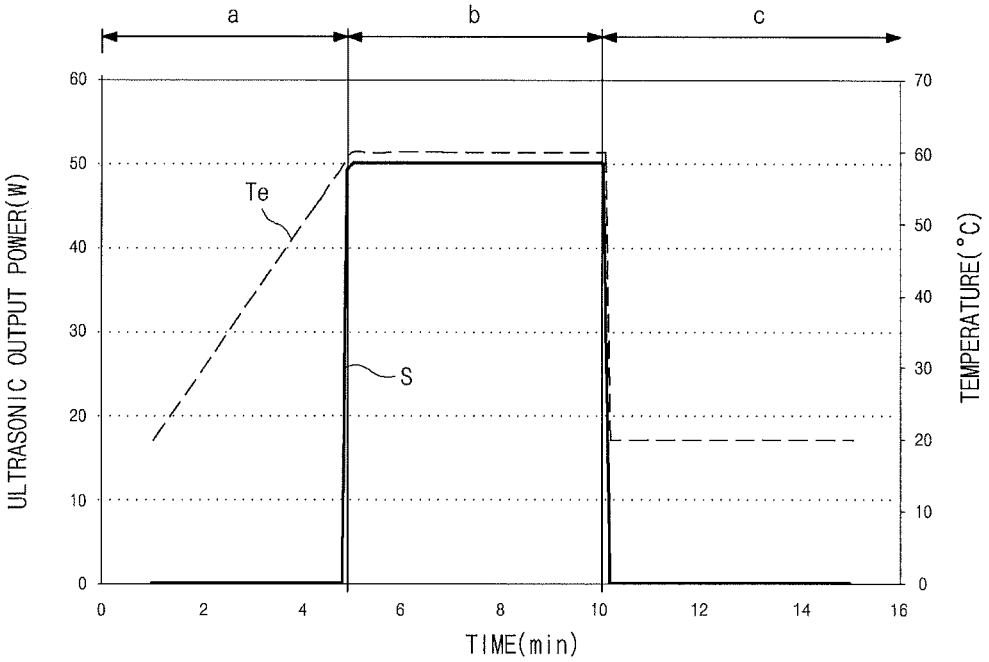
FIG. 16 is a view illustrating variation of the temperature of the water in the sump and the ultrasonic output power during one period of operation of a dishwasher according to another embodiment of the present disclosure.

FIG. 16 is a view illustrating variation of the temperature of the water in the sump and the output of ultrasonic waves during one period of operation of a dishwasher according to another embodiment of the present disclosure.

FIG. 16 shows the temperature Te of water in the sump 15 and the ultrasonic output power S during one period of the sterilization operation performed by the dishwasher 1. When the dishwasher 1 drives the heater 35 by starting the sterilization operation, the temperature of water in the sump 15 continues to rise. When the temperature Te of water in the sump 15 reaches a reference water temperature (for example, 60 degrees Celsius), the dishwasher 1 stops operation of the heater 35 (section a).

When the temperature Te of water in the sump 15 reaches the reference water temperature (for example, 60 degrees Celsius), the dishwasher 1 drives the ultrasonic generator 26 and increases the output S of ultrasonic waves radiated toward the sump 15 (for example, to 50 W). The dishwasher 1 radiates ultrasonic waves toward the sump 15 for the first reference time (Section b).

In Section b, ultrasonic waves enter the sump 15 which contains hot water, and thereby contaminants stuck to the inside of the sump 15 or the filters 22, 23 and 24 may be more easily separated, and higher pressure and higher temperature may be produced due to cavitation, allowing more effective elimination of microorganisms present in the sump 15 or at the filters 22, 23 and 24 through sterilization.

Then, the dishwasher 1 stops operation of the ultrasonic generator 26, and discharges the contaminated water from the sump 15 (Section c). At this time, the indicated value of the ultrasonic output power is 0, and the water in the sump 15 has a temperature lower than the reference water temperature. The dishwasher 1 may additionally perform resupply, sump circulation, and discharge of water in section c.

Figure 17:
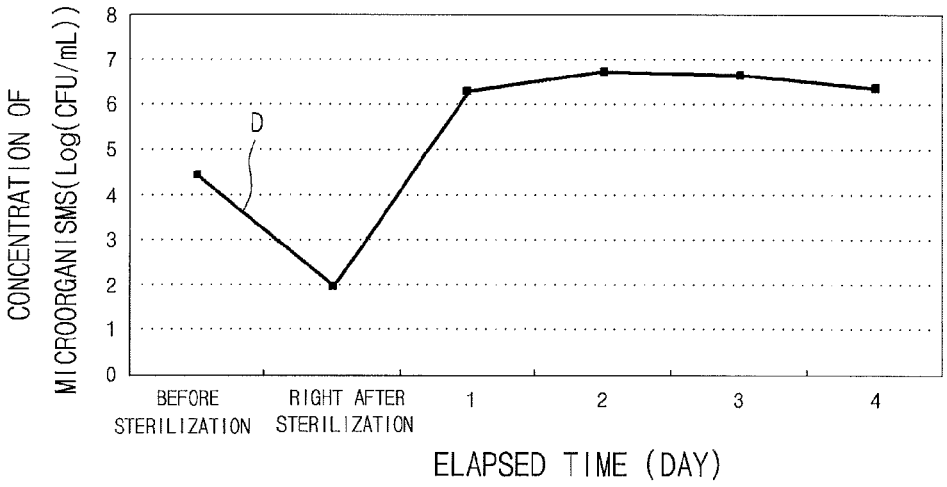
FIG. 17 is a graph showing a curve of reproduction of microorganisms after treatment with hot water according to the illustrated embodiment of the present disclosure.

FIG. 17 is a graph showing a curve of reproduction of microorganisms after treatment with hot water according to another embodiment of the present disclosure.

FIG. 17 shows variation of concentration D of microorganisms in the sump 15 when the dishwasher 1 performs the sterilization operation during one period as shown in FIG. 16.

The concentration D of microorganisms in the sump 15 is about 4.5 log (CFU/mL) before the dishwasher 1 performs sterilization. While the dishwasher 1 performs the sterilization operation, the concentration D of microorganisms in the sump 15 decreases to about 2 log (CFU/mL).

However, when the dishwasher 1 performs the sterilization operation once and stays in the standby mode, the concentration D of microorganisms in the sump 15 increases again. In this case, microorganisms in the sump 15 quickly adapt and become heat resistant. Accordingly, if the dishwasher 1 remains in the standby mode after performing the sterilization operation once, the concentration D of microorganisms may become higher than before the sterilization operation is performed.

Figure 18:
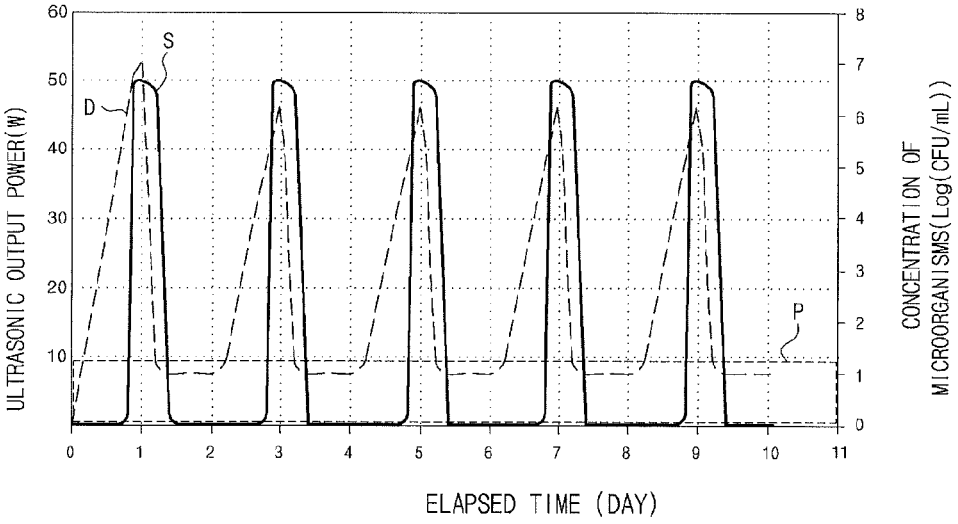
FIG. 18 is a graph showing variation of concentration of microorganisms as the sterilization is periodically performed according to the illustrated embodiment of the present disclosure.

FIG. 18 is a graph showing variation of concentration of microorganisms as the sterilization is periodically performed according to the illustrated embodiment of the present disclosure.

FIG. 18 shows variation of concentration D of microorganisms in the sump 15 and the ultrasonic output power S when the sterilization is performed multiple times with a period of the second reference time.

Even if the dishwasher 1 completes sterilization after performing the main functions of washing, rinsing, and drying, the concentration D of microorganisms in the sump 15 increases to about 7 log (CFU/mL) within one day.

When the dishwasher 1 performs the sterilization operation again after the second reference time has passed since termination of sterilization, the ultrasonic output power has the value of about 50 W, and the concentration D of microorganisms in the sump 15 decreases from about 7 log (CFU/mL) to about 1 log (CFU/mL) during the sterilization operation.

As the dishwasher 1 repeats the sterilization operation at every second reference time, the concentration D of microorganisms in the sump 15 may be maintained at a level lower than or equal to about 1 log (CFU/mL) which may cause the user to feel that the sump 15 is clean (section P).

As is apparent from the above description, a dishwasher according to one aspect of the present disclosure is provided with an ultrasonic generator to radiate ultrasonic waves toward a microfilter to automatically clean the microfilter, and therefore a user may not need to manually clean the microfilter.

In addition, a dishwasher according to another aspect of the present disclosure supplies hot water to a sump, and thereby sterilization may be intensified by the hot water and the vibration of an ultrasonic vibrator.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A method of controlling a dishwasher having a washing chamber to wash dishes; a sump concavely formed at a lower portion of the washing chamber to collect water used in washing; a cylindrically shaped microfilter having an open top and an open bottom disposed at the sump to filter out debris produced when the dishes are washed; and a cylindrically shaped ultrasonic generator to radiate ultrasonic waves toward the microfilter, the method comprising:

supplying water to the washing chamber;

spraying water in the sump arranged at a lower portion of the washing chamber onto dishes through a nozzle to wash the dishes;

discharging water used in washing the dishes from the sump to outside;

disposing the ultrasonic generator in the microfilter;

cleaning the microfilter by radiating ultrasonic waves outward in a radial direction from the ultrasonic generator disposed within the microfilter toward water contained in the sump to transfer the ultrasonic waves to the microfilter; and draining water remained in the sump after cleaning the microfilter.

2. The method according to claim 1, wherein the microfilter includes a filter membrane to filter out micro-contaminants; and a frame formed in a lattice shape to allow the filter membrane to maintain a constant shape, and wherein the method further comprises performing cleaning of the filter membrane while the discharging is performed.

3. The method according to claim 1, wherein the ultrasonic generator includes a vibration plate having an arc-shaped cross section of a metallic material; and an ultrasonic vibrator disposed at one surface of the vibration plate to vibrate the vibration plate, wherein the method further comprises:

disposing the vibration plate at an inner circumferential surface of the sump;

adjoining the ultrasonic vibrator to an outer circumferential surface of the vibration plate through the sump; and selectively performing the cleaning based on a turbidity of the water in the sump sensed through a turbidity sensor.

4. The method according to claim 1, wherein the ultrasonic generator includes a vibration plate having a flat plate shape; and an ultrasonic vibrator disposed at one surface of the vibration plate to vibrate the vibration plate, wherein the method further comprises:

disposing the vibration plate at an inner lower surface of the sump;

adjoining the ultrasonic vibrator to a lower surface of the vibration plate through the sump; and selectively performing the cleaning based on a turbidity of the water in the sump sensed through a turbidity sensor.

5. A method of controlling a dishwasher having a body provided therein with a washing chamber to wash dishes and a sump concavely formed at a lower portion of the washing chamber; at least one nozzle disposed in the washing chamber to spray water toward the dishes disposed in the washing chamber; at least one a cylindrically shaped microfilter having an open top and an open bottom disposed at the sump to filter out debris; and an ultrasonic generator disposed at the sump to radiate ultrasonic waves toward the microfilter, the method comprising:

disposing the ultrasonic generator in the microfilter;

installing a coarse filter through the open top of the microfilter;

installing a fine filter to cover the sump; and supplying water to the sump to a predetermined reference water level where the microfilter disposed in the sump is submerged, wherein ultrasonic waves are radiated outwardly in a radial direction from the ultrasonic generator toward the water contained in the sump to transfer the ultrasonic waves to the microfilter.

6. The method according to claim 5, wherein the microfilter includes a filter membrane to filter out micro-contaminants; and a frame formed in a lattice shape to allow the filter membrane to maintain a constant shape, wherein the method further comprises heating the water supplied to the sump.

7. The method according to claim 5, wherein the ultrasonic generator comprises an ultrasonic vibrator formed in a shape of a cylinder having a smaller diameter than the microfilter.

8. The method according to claim 5, wherein the ultrasonic generator includes a vibration plate formed of a metallic material; and an ultrasonic vibrator, and the method further includes disposing the ultrasonic vibrator at one surface of the vibration plate to vibrate the vibration plate.

9. The method according to claim 5, wherein the dishwasher further includes a circulation pump, a circulation pipe, a drain pump and a drain pipe, wherein the method further comprises:

transferring the water in the sump to the nozzle via the circulation pump and the circulation pipe;

discharging the water from the sump to outside via the drain pump and the drain pipe.

* * * * *